US008640662B2

(12) United States Patent
Cole et al.

(10) Patent No.: US 8,640,662 B2
(45) Date of Patent: Feb. 4, 2014

(54) VALVE TIMING CONTROL APPARATUS AND METHOD

(75) Inventors: Joe S. Cole, Mesquite, TX (US); Jack D. Hutcheson, Garland, TX (US); Kenneth Parker, Lake Orion, MI (US); Wes Gerszewski, Coppell, TX (US); Steve Nance, Highland Village, TX (US); Daniel Viertler, Bad Urach (DE); Markus Todt, Nürtingen (DE); Holger Bergemann, Nürtingen (DE)

(73) Assignee: Hilite Germany GmbH (DE)

( * ) Notice: Subject to any disclaimer, the term of this patent is extended or adjusted under 35 U.S.C. 154(b) by 178 days.

(21) Appl. No.: 13/343,174

(22) Filed: Jan. 4, 2012

(65) Prior Publication Data

US 2013/0000578 A1 Jan. 3, 2013

Related U.S. Application Data

(63) Continuation of application No. PCT/US2012/020087, filed on Jan. 3, 2012.

(60) Provisional application No. 61/429,515, filed on Jan. 4, 2011.

(51) Int. Cl.
*F01L 1/34* (2006.01)

(52) U.S. Cl.
USPC ..... 123/90.17

(58) Field of Classification Search
USPC ..... 123/90.12, 90.15, 90.17, 90.33, 90.34; 464/160, 161
See application file for complete search history.

(56) References Cited

U.S. PATENT DOCUMENTS

| | | | |
|---|---|---|---|
| 5,497,738 | A | 3/1996 | Siemon et al. |
| 5,813,378 | A | 9/1998 | Sato |
| 5,901,674 | A | 5/1999 | Fujiwaki |
| 6,173,687 | B1 | 1/2001 | Fukuhara et al. |

(Continued)

FOREIGN PATENT DOCUMENTS

| | | |
|---|---|---|
| DE | 102004039800 | 7/2006 |
| DE | 102008059196 | 6/2010 |

(Continued)

OTHER PUBLICATIONS

International Search Report, issued Mar. 19, 2012, by the ISA/EP, in connection with PCT/US2012/020087.

(Continued)

*Primary Examiner* — Thomas Denion
*Assistant Examiner* — Daniel Bernstein
(74) *Attorney, Agent, or Firm* — Clark Hill PLC

(57) ABSTRACT

A valve timing control apparatus for a combustion engine according to which a rotational member, such as a sprocket, is driven by said combustion engine, a rotor is mechanically coupled with a camshaft for controlling opening and closing of cylinder valves of said combustion engine, a first configuration is provided in which the rotor is locked to the rotational member; and a second configuration is provided in which the rotor is unlocked from said rotational member. In another aspect an operating method of said valve timing control apparatus for adjusting a valve timing of a combustion engine is provided. The apparatus controls a relative rotation between a camshaft and an output shaft, which can either be prevented or permitted.

21 Claims, 21 Drawing Sheets

(56) References Cited

U.S. PATENT DOCUMENTS

| | | | | |
|---|---|---|---|---|
| 6,263,846 | B1 | 7/2001 | Simpson et al. | |
| 6,378,475 | B2 | 4/2002 | Takenaka et al. | |
| 6,386,164 | B1 | 5/2002 | Mikame et al. | |
| 6,439,184 | B1 | 8/2002 | Takenaka et al. | |
| 6,443,112 | B1 | 9/2002 | Kinugawa | |
| 6,477,996 | B2 | 11/2002 | Ogawa | |
| 6,481,402 | B1 | 11/2002 | Simpson | |
| 6,668,778 | B1 | 12/2003 | Smith | |
| 6,684,835 | B2 | 2/2004 | Komazawa et al. | |
| 6,779,499 | B2 | 8/2004 | Takenaka et al. | |
| 6,779,500 | B2 | 8/2004 | Kanada et al. | |
| 6,820,578 | B2 | 11/2004 | Kanada et al. | |
| 6,880,505 | B2 | 4/2005 | Kinugawa et al. | |
| 6,883,481 | B2 | 4/2005 | Gardner et al. | |
| 6,968,818 | B2 | 11/2005 | Plank et al. | |
| 6,976,460 | B2 | 12/2005 | Komazawa et al. | |
| 7,444,254 | B2 * | 10/2008 | Tsukada et al. | 702/114 |
| 7,444,971 | B2 * | 11/2008 | Suga et al. | 123/90.17 |
| 7,513,230 | B2 | 4/2009 | Knecht | |
| 7,841,311 | B2 | 11/2010 | Hutcheson et al. | |
| 7,931,000 | B2 | 4/2011 | Ushida et al. | |
| 8,033,257 | B2 | 10/2011 | Fischer | |
| 8,146,550 | B2 * | 4/2012 | Takemura | 123/90.17 |
| 8,201,529 | B2 * | 6/2012 | Yamaguchi et al. | 123/90.17 |
| 8,210,142 | B2 * | 7/2012 | Suzuki et al. | 123/90.17 |
| 8,267,058 | B2 * | 9/2012 | Suzuki et al. | 123/90.17 |
| 2002/0029651 | A1 | 3/2002 | Sluka et al. | |
| 2002/0078913 | A1 | 6/2002 | Fukuhara | |
| 2005/0132991 | A1 | 6/2005 | Knecht | |
| 2007/0107684 | A1 | 5/2007 | Takahashi | |
| 2010/0199937 | A1 | 8/2010 | Fujiyoshi | |
| 2010/0300388 | A1 | 12/2010 | Lang et al. | |
| 2011/0017156 | A1 | 1/2011 | Smith | |
| 2011/0035134 | A1 | 2/2011 | Urushihata | |
| 2011/0315104 | A1 | 12/2011 | Imamura et al. | |

FOREIGN PATENT DOCUMENTS

| | | |
|---|---|---|
| EP | 0799977 | 10/1997 |
| EP | 2154338 | 2/2010 |
| EP | 1787012 | 11/2010 |
| EP | 2412944 | 2/2012 |
| JP | 2009-250073 | 10/2009 |
| JP | 2010-138862 | 6/2010 |
| JP | 2010-209780 | 9/2010 |
| JP | 2011-069287 | 4/2011 |
| JP | 2011-163270 | 8/2011 |
| WO | WO 2010/061936 | 6/2010 |
| WO | WO 2010/119322 | 10/2010 |

OTHER PUBLICATIONS

Written Opinion, issued Mar. 19, 2012, by the ISA/EP, in connection with PCT/US2012/020087.

* cited by examiner

VALVE TIMING CONTROL APPARATUS AND METHOD

CROSS-REFERENCE TO RELATED APPLICATIONS

This application claims the benefit of the filing date of U.S. provisional patent application No. 61/429,515, filed Jan. 4, 2011, the entire disclosure of which is incorporated herein by reference.

This application is a continuation of co-pending international application number PCT/US12/20087, filed Jan. 3, 2012, which claims priority to U.S. provisional patent application No. 61/429,515, filed Jan. 4, 2011, the entire disclosures of which are incorporated herein by reference.

BACKGROUND

The present disclosure relates in general to valve timing control apparatuses, and in particular to variable valve timing control apparatuses for internal combustion engines. The valve timing control apparatus controls a relative rotation between a camshaft and an output shaft, which can either be prevented or permitted by releasably locking a relative rotation of a rotor being driven by said camshaft with a rotational member, preferably a sprocket, a chain, a belt, a pulley being driven by said output shaft.

From the state of the art a cam phasing device as part of a variable valve timing control apparatus is well known that is applicable to internal combustion engines, such as described in U.S. Pat. No. 7,841,311 B. Especially with camshafts that include adjustable cams for intake and exhaust gas exchange valves of cylinders of a combustion engine on the same camshaft, a cam phaser device may be needed. Any kind of camshaft can be operated that has one or two different sets of cams, whereby the cams can be arranged on the same camshaft or on different camshafts. The device is applicable in an automotive environment as an automotive component.

A variable valve timing control apparatus of an internal combustion engine is a device that adapts the relative position of a gas exchange valve actuating component, such as a cam, with respect to a further shaft, such as a crankshaft. It is widely known to use camshafts for transmitting the actuating impulse. The impulse is applicable on at least one—normally several—gas exchange valves via a control shaft. The control shaft can have at least two concentrically arranged camshafts, or can have two separate camshafts arranged in parallel. The camshafts are adjustable in a rotatable manner with respect to a rotational member, e.g., a sprocket, a toothed belt, a pulley or a gear assembly, which is powered by the engine's rotational movement. The adjustment is achieved by adjusting a cam of the first camshaft in terms of its angle towards a cam of the second camshaft. To select the position, a cam phasing device is needed. The cam phasing device operates by rotatable vanes which are part of a rotor, provoking a swiveling relative movement between a driven member and an output member, which can be a rotor connected with a camshaft for opening and closing cylinder valves of the combustion engine.

The rotor's vanes can be profiled or can be flat, three-dimensional blocks extending out of the central rotor which can be referred to as rotor cores. The central rotor and the vanes are part of a vane adjuster. The cam phasing device can include at least two pivotable vane adjusters. Each pivotable vane adjuster is assigned to one of the two camshafts. In particular, a first vane adjuster is fixed to a first camshaft and a second vane adjuster is fixed to a second camshaft. The first vane adjuster operates the first camshaft whereas the second vane adjuster operates the second camshaft. The pivotable vane adjusters can be arranged axially one after the other in a direction of a valve control shaft. Both vane adjusters can be arranged on a common axis or can be arranged on parallel axes. The vane adjusters usually do not influence each other in their maximum swivel range. The first vane adjuster may still cover its full range while the second vane adjuster has picked any position between its maximum advanced and its maximum retarded position. With this design, the position of a first camshaft does not influence the selectability of a position for the second camshaft still occupying the same elongated space.

The variable valve timing control apparatus can further include rotor-type vane adjusters in that each pivotable vane adjuster is designed in a rotor-type manner. Each rotor-type vane adjuster can be changed in respect of its phase by hydraulic pressure in two sets of hydraulic chambers, which can provide a retard and an advance region of the valve timing control apparatus. The phase is measured in respect of a further shaft, such as the camshaft. The two sets of hydraulic chambers—retard and advance regions—form counter moving chambers to each other. The pivotable vane adjusters each constitute an output member of one of the camshafts. Each output member includes a vane rim. The vane rims are attached to rotor cores being movable between a first position and a second position limited by division bars of a surrounding stator housing. By using the design of vane-type cam phasers—which are known to a certain extent by themselves—a very fast and very responsive adjuster can be created.

In some cases, the variable valve timing control apparatus can include a double camshaft. The gas exchange valve control shaft is thereby a coaxially arranged double camshaft. The first camshaft can be formed of said double camshaft as a hollow body and the second camshaft is aligned in the hollow body and is placed in such a manner that through at least one recess a cam of the second camshaft pokes out to an outside of the first camshaft. The double camshaft is very efficient in terms of space. It occupies very little additional space outside of the camshaft as is necessary and advantageous in internal combustion engines.

Frequently, the variable valve timing control apparatus has only one drive pulley. The drive pulley is exposed to a driving means, such as a chain or a belt. Thus the cam phasing device has only one drive pulley, such as a sprocket, a toothed belt, a pulley, a gear box, etc., adapted to be driven by a chain which can surround a crankshaft of the internal combustion engine. The variable valve timing control apparatus has a side which is a near side of the camshaft, and the variable valve timing control apparatus has a side which is a far side from the camshaft. The variable valve timing control apparatus can be planar. The variable valve timing control apparatus has a communication collar on the near side. The near side bears conduits for intake and piping of a hydraulic fluid to each of the sets of chambers of the first and said second pivotable vane adjusters. The communication collar moves synchronously along with the drive pulley. The integration of hydraulic conduits for the first and second vane adjusters can contribute to the compactness of the variable valve timing control apparatus. The same applies to using only one drive pulley. The variable valve timing control apparatus has at least four conduits. Two of the four conduits are located in the vicinity of an axis of the camshaft which channel fluid from the communication collar to the pivotable vane adjuster. They conduct hydraulic fluid, such as engine oil, to the vane adjuster which is located farther away from the communication collar than the second pivotable vane adjuster. The two of the four conduits are located remotely from the axis of the camshaft channel from the communication collar to the second pivotable vane adjuster. The second vane adjuster is located closer to the communication collar. In a very dense circular cross-section, all conduits necessary for operation can be placed in the rotor core and the core of the variable valve timing control apparatus.

It is an object to further improve the above-described valve timing control apparatus.

SUMMARY

According to an embodiment, a valve timing control apparatus for a combustion engine is proposed, including a rotational member, preferably a sprocket, a belt, a chain a pulley or any other device being driven by said combustion engine, and a rotor being mechanically coupled with a camshaft for controlling opening and closing of cylinder valves of said combustion engine. In a first configuration the rotor is locked to the rotational member, thus the rotor and the rotational member have a fixed phase while rotating. In a second configuration the rotor is unlocked from the rotational member, such that a switching phase of the valves in relation to the engine's rotational state can be controlled by an adjustable relative position between said rotational member and said rotor.

In other words, the valve timing control apparatus controls a relative rotation between a camshaft and an output shaft of the combustion engine, which can be either prevented or permitted. Said rotor is connected to said camshaft for switching input and output valves of one or multiple cylinders of said combustion engine. The rotor is releasably locked to a rotational member, e.g. a sprocket, toothed belt, pulley or gear box, connected to said output shaft of said combustion engine, to thereby prevent relative rotation between the camshaft and the output shaft by a locking pin. The locking pin is driven by a hydraulic system which controls said cam phasing adjustment. Thus, the locking pin blocks or enables a cam phasing adjustment between opening and closing of cylinder valves and a rotational state of the combustion engine.

In an embodiment the valve timing control apparatus includes a locking pin being axially aligned with said rotational member and said rotor, wherein said locking pin is hydraulically operated for locking said rotational member with said rotor in an intermediate position. An intermediate position can be any position between an advance- and retard-end-position defining a hydraulic advance chamber and a hydraulic retard chamber of equal (mid-position) or different volume. Thereby an intermediate position can be an arbitrary position between said end-positions and a mid-position and as a special case of an intermediate position a middle position is defined as a middle position between said end-positions. Said intermediate position can be a position near to a retard end position or a position near to an advance end position providing a larger phase shift capability in an advance or in a retard phase direction. Said locking pin engaging or releasing said rotor from said rotational member is driven by a hydraulic system for adjusting a cam phase between said rotational member and said rotor. The locking pin is aligned with an axis of the camshaft and the rotational member and the rotor, and is displaced via said axis by a certain distance. Engaging and releasing said locking pin is driven by a hydraulic system which operates with pressure of a fluid, wherein the locking pin is in an inactive state in a locked position by a force from a compression spring. The locking pin can be hydraulically operated, which means it can hydraulically released or engaged by applying pressure to a hydraulic system, wherein the hydraulic system can also provide relative adjustment of the rotor with respect to the rotational member by adjusting a relative position of the rotor to the rotational member in a positive or negative cam phase. Using a common hydraulic system for adjusting cam phase and releasing said locking pin enables the release of the locking pin simultaneously when pressurizing a hydraulic chamber for advancing or retarding valve timing of the cylinder valves. An intermediate position locking provides a fast adjustment in a negative or positive angle of the timing phase.

According to an embodiment said rotor includes a plurality of vanes and is rotatably embedded in a stator, preferably in a stator housing, including a plurality of division bars, such that in said intermediate position of said rotor with respect to said stator, a retard region and an advance region of equal or different volume are provided between lateral walls of said vane and said division bar. In an embodiment said rotational member is a sprocket. The retard region and the advance region are understood as hydraulic chambers, wherein pressurizing fluid in a retard region causes a cam shift in a negative phase while applying pressure to the chamber of the advance region causes a positive phase shift of the cam delay with respect to the rotational state of the combustion engine. In said intermediate position, both regions can have an equal or a different volume such that the rotor can be adjusted in a negative or positive angle in an equal amount with respect to the rotational member. The stator includes a stator housing and a rotational member, such as a sprocket, a pulley or a gear. The retard region and the advance region are defined by lateral walls of said vane of said rotor and by lateral walls of said division bars of said stator housing. It is conceivable that only one vane and only two neighboring division bars define the hydraulic system of the valve timing control apparatus, but also a plurality of vanes and a plurality of division bars can define a plurality of retard and advance regions such that the hydraulic system operates a plurality of pressure chambers.

According to an embodiment said locking pin includes a compression spring for forcing said locking pin in a pressureless hydraulic state in a locking position in a recess in said stator, preferably in said sprocket, pulley or gear. Since a stator includes a stator housing and a rotational member as a sprocket, pulley or gear, it is also conceivable, that said locking pin can be forced in a locking position in a recess of said stator housing. Said locking pin can be provided as a bushing-type or pot-type cylindrical pin, wherein in the inner hole of the pin a compression spring can be supported for defining a locked position in a pressureless state.

The locking hole chamber can be vented to the atmosphere by a vent passage, such as a front vent passage depicted in the figures. In a further embodiment said locking pin includes a locking hole chamber in the recess of the stator (a recess in said stator housing or a recess in said rotational member such as sprocket, pulley or gear) and a locking ring chamber in an annular channel between locking pin and vane. If the rotor includes only a small amount of vanes, e.g. three vanes or less, the width of each vane can be designed so broad, that a locking hole recess is covered even in an end position of said rotor with respect to said stator. In such a case, locking hole chamber and locking ring chamber can be hydraulically decoupled. A vent hole towards atmospheric pressure or towards the main oil gallery of the engine can be provided in the locking hole recess and the locking pin can be activated by pressurizing the locking ring chamber. Preferably both channels are in fluid communication with each other via a connection passage for engaging or releasing the locking pin for providing a two step locking pin. Providing a two step locking pin, whereby locking hole chamber and locking ring chamber are fluidly connected by a connecting passage is advantageous in a rotor design with a rather large number of vanes, e.g. four vanes or more, whereby the width of each vane is rather thin. Thus when rotatably moving said rotor against said stator in an end position, the locking hole of the stator (being located either in the stator housing or in the rotational member as said sprocket) can be set free and hydraulic fluid could flow out of the advance region (advance chamber) or said retard region (retard chamber) into the main oil gallery of the engine. In this case connecting locking hole chamber with locking ring chamber and hydraulically decoupling locking hole chamber from the main oil gallery prevents a loss of hydraulic fluid from either retard or advance region in an end position of the stator. The axial end of the locking pin and the recess of the sprocket can define a locking hole chamber and the enlarged diameter of the locking pin together with a section of the outer peripheral region of said pin-cylinder and its guiding hole in the rotor can provide a locking ring chamber, wherein both chambers, locking ring chamber and locking hole chamber, can be connected via a connection passage with a flow resistance R2 being sufficiently low such that fluid can force the locking pin from an engaged to a released position by introducing pressure into the locking hole chamber and/or in the locking ring chamber.

According to an embodiment said hydraulic system includes a pump, a proportional oil control valve being in fluid communication with said pump via a pressure passage, said retard region and said advance region being in fluid communication with said oil control valve by an advance passage and a retard passage. Said locking pin can be in fluid communication either with said pump, with said oil control valve or with said retard region and said advance region. An on/off control valve can be in fluid communication with said locking pin via a release passage for switching said locking pin between a locked position and a released position, wherein said on/off control valve is in fluid communication with an oil reservoir via an oil return passage. The pump provides hydraulic pressure for operating the hydraulic system for cam phasing a camshaft with respect to an output shaft of the combustion engine. An oil control valve, which can be a 4/3 or 4/4 valve, controls locking, positive or negative, cam phasing or depressurizing of the hydraulic system of the valve timing control apparatus. On the input side of the oil control valve a pressure passage and a connection passage to an oil reservoir can be connected. On the output side of the oil control valve an advance passage and a retard passage for pressurizing an advance region and a retard region of said rotor can be connected. The hydraulic system for releasing or engaging the locking pin can be connected to the pressure passage of said pump or to both the advance and retard passage for pressurizing the advance or retard region of said rotor. Thus, in a first case, the locking pin can be engaged or released independently from applying pressure to an advance region or a retard region of the rotor, while in the second case, the locking pin can be driven while pressurizing the advance or the retard region for providing a positive or negative cam phasing. Preferably said on/off control valve and said oil control valve are provided as separate valve units. Providing two functionally and structurally separate valve units, a proportional valve unit, preferably a 4/3- or 4/4-valve as oil control valve and a 2/2 binary switching or also proportional on/off control valve provide a cheaper and more robust valve timing control apparatus as an integrated design of both valve functionalities—proportional oil control and on/off switching functionality in a single valve unit. Such a combined design is rather expensive and increases malfunction of the valve timing control apparatus.

According to an embodiment at least lateral walls of said vane include an A-port passage and a B-port passage between said retard and advance region and said locking pin. Said locking pin can be in fluid communication with said on/off control valve via a release passage, wherein each A/B-port passage includes a check valve preventing an exchange of hydraulic fluid between said retard and advance region side or at least an orifice with a flow resistance R1, such that said locking pin is hydraulically coupled with said retard and advance region via said A-port and B-port passage and hydraulic fluid is flowable in a very small amount between said retard/advance region through said locking pin towards said on/off control valve. In other words, the hydraulic system is directly connected via said A-port and B-port of a lateral wall through the retard and advance region of said rotor with said locking pin, such that when pressurizing the advance or the retard region, hydraulic fluid can enter the respective port for releasing said locking pin such that a cam phasing can be adjusted. For preventing an exchange of hydraulic fluid between said advance region and retard region, check valves or orifices can limit the amount of flow or can prevent a fluid exchange. Said check valves or orifices can be provided in said A-port and said B-port, which allow a sufficient flow of hydraulic fluid for enabling releasing of said locking pin but preventing flow of hydraulic fluid from one region to another region. Regularly said oil pump comprises another check valve preventing a backflow of hydraulic fluid from the hydraulic system backwards through the pump into said oil reservoir.

According to an embodiment at least lateral walls of a vane include an A-port passage and a B-port passage between said retard and advance regions and said locking pin, and said locking pin is in fluid communication with said on/off control valve via two separate release passages, wherein both A-port and B-port passages are hydraulically decoupled from each other and coupled with separate release passages via said locking pin such that said locking pin is hydraulically separately coupled with said retard and advance region by said A-port and B-port passages. Hydraulic fluid flows separately between said retard/advance regions through said locking pin through separate release passages towards said on/off control valve. Preferably said assembly of locking pin, rotor vane and stator provide a locking hole chamber and a locking ring chamber being hydraulically decoupled from each other, whereby said A-Port passage is connected with said locking hole chamber and said B-port passage is connected with said locking ring chamber. Thus said locking pin is provided as two step locking pin. The on/off control valve provides the possibility of separately switching said locking pin, which enables a pre-pressurizing of said advance or retard region, and by opening said on/off control valve a locking pin is released or engaged for a fast phase switching of the valve control timing control apparatus. In this embodiment, two separate fluid systems connect the advance region with the locking pin and the on/off check valve and said retard region with said locking pin and said on/off control valve. Liquid fluid from the advance and the retard region does not mix, such that an orifice or check valves are not needed for preventing exchange of hydraulic fluid between said retard and said advance region. The before mentioned two step locking pin concept with a complete separation of A-port and B-port passages or A- and B-locking pin supply passages for independently pressurizing locking hole chamber and locking ring chamber in an hydraulically decoupled way can easily be employed to each of the different embodiments of the invention, preferably to embodiments depicted in FIGS. 18*a* to 18*d*.

According to an embodiment said locking pin is in fluid communication with said on/off control valve by a locking pin activation passage and by said release passage, said locking pin activation passage and said release passage being in fluid communication with a locking pin supply passage, the locking pin supply passage is either in fluid communication with said advance passage and said retard passage via an A-locking pin supply passage and a B-locking pin supply passage, connecting said retard region and said advance region with said oil control valve, or said locking pin supply passage is in fluid communication with said pressure passage connecting said pump with said oil control valve, such that said retard/advance region are hydraulically decoupled from said locking pin. According to this embodiment, the hydraulic system for locking and releasing said locking pin is separated from the hydraulic advance and retard region chambers. The locking pin supply passage for supplying hydraulic pressure for releasing said locking pin is either connected to said pressure passage connecting said pump with said oil control valve or is connected to said advance passage and/or retard passage such that hydraulic pressure is supplied if the advance and/or the retard passage are pressurized for adjusting the cam phase. Connecting the hydraulic sub-system for releasing said locking pin with said pressure passage enables locking and releasing said locking pin independently from adjusting said cam phase. Connecting the hydraulic sub-system for releasing said locking pin with said A- and said B-locking pin supply passage enables locking and releasing said locking pin depending on an adjustment of said cam phase. The A-locking pin supply passage and the B-locking pin supply passage connect said advance passage and said retard passage with said locking pin supply passage. The locking pin is driven by the locking pin activation passage, which can also be labeled as locking pin vent oil passage, which when pressurized, releases said locking pin and which, when in a depressurized state, locks said locking pin, advantageously with the help of a compression spring. Thus, hydraulic fluid does not flow from the advance and retard region directly to said locking pin but bypasses the advance and retard chamber for enabling locking or releasing of said locking pin. Therefore a mixing of fluid from advance and retard region is prevented. In a locking position the pressure from the pump is not cut off by a blocked center valve position but for instance due to the fact that the engine is off and consequently the oil pump is also off.

According to an embodiment said locking pin supply passage includes an orifice having a flow resistance R3 and/or said A-port passage/A-locking pin passage and B-port passage/B-locking pin passage include an orifice having a flow resistance R1 being much larger than the flow resistance R3, such that R3 is much smaller than R1 (R1>>R3). In other words, said locking pin supply passage can have a big diameter and a short length such that the hydraulic fluid can flow without resistance through said locking pin supply passage making R3 almost zero. In contrast thereto, said A-locking pin supply passage/A-port passage and B-locking pin supply passage/B-port passage connecting said locking supply passage with said oil control valve or with the pressure passage have a rather large flow resistance such that only a small amount of hydraulic fluid flows for releasing said locking pin, whereby said A-locking pin supply passage/A-port passage and B-locking pin supply passage/B-port passage connect said advance and retard passage, such that only a small amount of hydraulic fluid can flow from said advance passage to said retard passage through said comparatively high flow resistance R1.

According to an embodiment said A-locking pin supply passage and said B-locking pin supply passage and/or said locking pin supply passage include a check valve preventing an exchange of hydraulic fluid between said retard and advance passage regions. Said check valve can be included in said A-locking pin supply passage and/or said B-locking pin supply passage and can also be included in said locking pin supply passage. The check valve prevents mixing of hydraulic fluid of said advance and retard passage.

According to an embodiment said on/off control valve is arranged centrally in a hub of said rotor, such that said locking pin supply passage can be provided with a flow resistance R3 of practically zero. This embodiment suggests to arrange said on/off control valve inside said rotor in a central position such that said valve can rotate with said rotor and can provide a locking pin supply passage with at least a very small flow resistance, such that the locking pin supply passage is practically not existent and can be designed with a very short length and with a large diameter.

According to an embodiment the check valve can be a shuttle valve, including two input and one output port. The shuttle valve does not prevent a unidirectional flow from one port to another port but prevents flow from one input port to another input port, but allows flow from either input ports to the output. Thus, the two check valves can be designed as a shuttle valve for preventing exchange of hydraulic fluid between said advance and retard region.

According to another aspect a method for adjusting a valve timing of a combustion engine according to one of the foregoing embodiments is proposed. Said method includes the steps of providing pressurized hydraulic fluid in a hydraulic system at an input port of an oil control valve; bringing said oil control valve in an advance phase or retard phase position whereby hydraulic fluid in said advance or retard passage is pressurized; and switching between said first configuration in which said rotor is in a locked position with said stator including said rotational member and in said second configuration in which said rotor is released from said stator including said rotational member. In other words the method proposes to bring said oil control valve in a valve position for adjusting said relative rotational position between said rotor and said stator to a defined position and to switch between a locking position (first configuration) and a release position (second configuration) of rotor with respect to said stator. In various embodiments said switching depends on a combination of valve positions of said oil control valve and said on/off control valve, or solely depends on a valve position of said on/off control valve. Pressure from the oil pump is provided as long as said engine is running.

According to an embodiment of the operating method said first configuration is a locked position of said locking pin, locking said rotor with said stator including said rotational member in an intermediate position, and said second configuration is a released position of said locking pin releasing said rotor from said stator such that said rotor's rotational position with respect to said stator can freely be adjusted between an advance end position and a retard end position. The advance and retard end positions are defined as positions of maximal advance phase angle or maximal retard phase angle of said rotor with respect to said stator, structurally it can be seen as a position of the rotor, in which a lateral side wall of a rotor is in close contact with a lateral wall of a stator housing division bar, whereby a hydraulic volume of said advance or retard region (chamber) is minimized.

According to an embodiment of the operating method releasing and locking said locking pin is operated by a locking-pin hydraulic system including an on/off valve being functionally and structurally separate form said oil control valve and being provided for switching between said first and said second configuration, whereby said locking-pin hydraulic system is at least partly decoupled from said hydraulic system for pressurizing said advance and retard region. Said locking pin hydraulic system can decouple hydraulic fluid being pressurized in said advance and retard chamber defined by rotor and stator assembly from hydraulic fluid within said locking pin locking chamber (locking hole chamber and/or locking ring chamber), such that hydraulic fluid of said advance/retard region can be pressurized independently from hydraulic fluid for operating said locking pin. A vane of said rotor including said locking pin can be manufactured without additional bores or check valves reducing production costs, and a risk of fluid leakage between advance and retard region through bores of said vane is minimized.

It is understood that variations may be made in the foregoing without departing from the scope of the disclosure. For example, one or more of the above-described exemplary embodiments may include one or more of the elements and teachings of the embodiments disclosed in U.S. Pat. No. 7,841,311, the entire disclosure of which is incorporated herein by reference.

DETAILED DESCRIPTION

Figure 1:
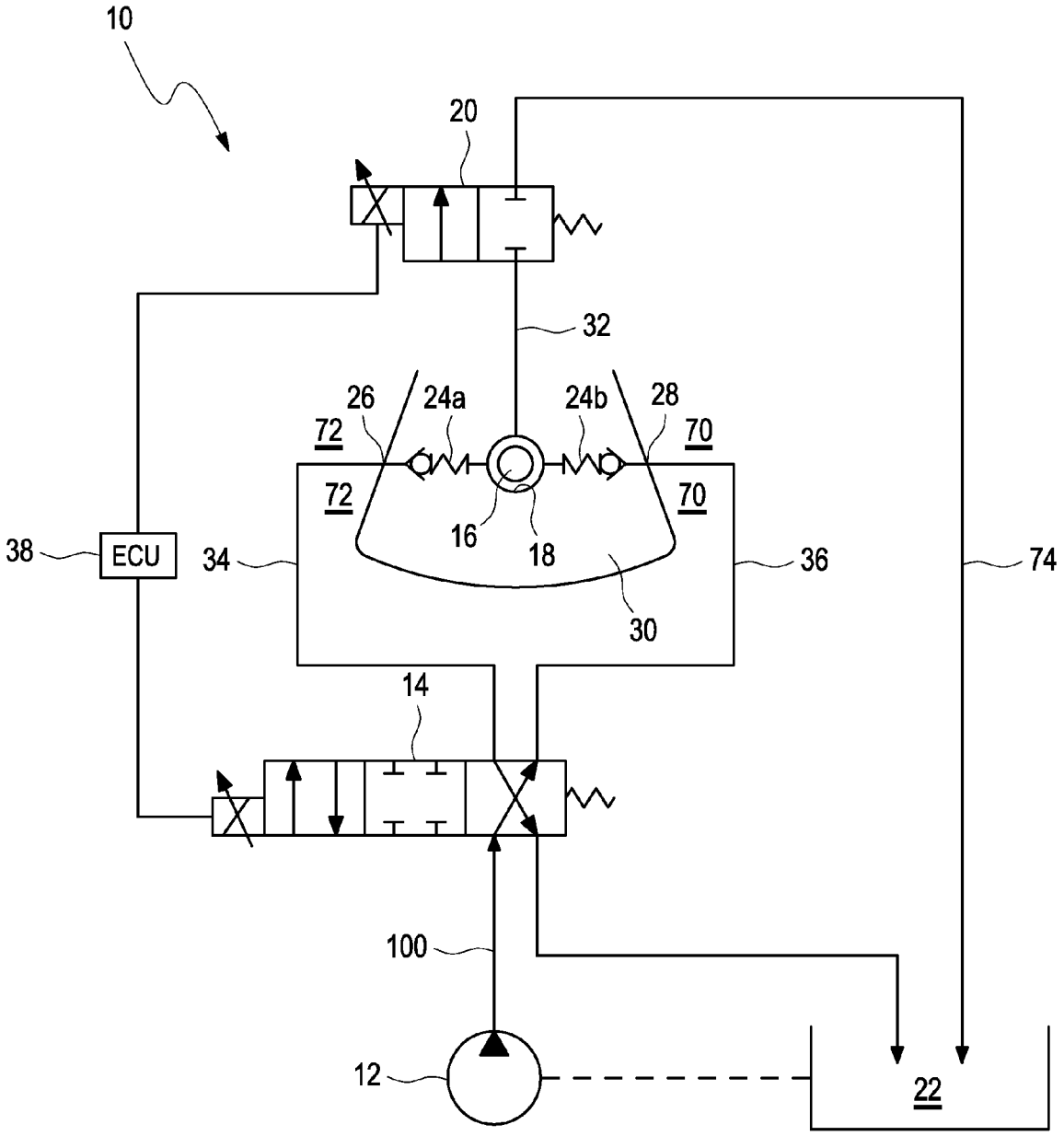
FIG. 1 is a diagrammatic illustration of a valve timing control apparatus, according to an exemplary embodiment.

In an exemplary embodiment, as illustrated in FIG. 1, a valve timing control apparatus 10 is provided and includes a pump 12 and an oil control valve 14 in fluid communication therewith via an oil pressure passage 100. An axially extending locking pin 16 extends within a bore 18, which is in fluid communication with the oil control valve 14 via ports A and B and respective check valves 24*a*, 24*b*. In an exemplary embodiment, the check valves 24*a*, 24*b* are configured to permit one-way fluid flow from the oil control valve 14 and into the bore 18 via the ports A and B, respectively. The bore 18 is in fluid communication with an on/off control valve 20. An oil reservoir 22 is in fluid communication with each of the oil control valve 14 and the on/off control valve 20. In an exemplary embodiment, the oil control valve 14 is a 3-position, 4-way valve. In an exemplary embodiment, the oil control valve 14 is a 4-position, 4-way valve. In an exemplary embodiment, the on/off control valve 20 is a 2-position, 2-way valve. In an exemplary embodiment, an engine control unit (ECU) 38 is operably coupled to each of the oil control valve 14 and the on/off control valve 20, and the ECU 38 is configured to control the operation of each of the valves. In several exemplary embodiments, the ECU 38 includes, for example, one or more of the following: a programmable general purpose controller, an application specific integrated circuit (ASIC), other controller devices and/or any combination thereof. In an exemplary embodiment, the ECU 38 includes a computer system, hardware, software, a computer readable medium, and/or any combination thereof.

In an exemplary embodiment, as illustrated in FIGS. 2*a*, 2*b*, 2*c* and 2*d* with continuing reference to FIG. 1, the valve timing control apparatus 10 further includes a rotor 40, which is operably coupled to a camshaft 42 so that rotation of the rotor 40 causes the camshaft 42 to rotate. The rotor 40 includes a center portion 44 and a plurality of vanes 30 extending radially outwardly therefrom. The bore 18 is formed, and axially extends through one of the vanes 30 in the plurality of vanes 30. The A-port 26 is formed through one side surface of the vane 30 through which the bore 18 is formed, and the B-port 28 is formed through the other side surface of the vane 30. An axial slot 46 is formed in the distal surface of the vane 30 through which the bore 18 is formed. A radial passage 68 is formed in the rotor 40, and extends between the bore 18 and the axial slot 46. The rotor 40 is disposed within a housing 54, which is coupled to a rotational member such as, for example, a sprocket 50. In an exemplary embodiment, the housing 54 includes a circumferentially extending portion that extends about the rotor 40, and a plurality of protrusions extending radially inwardly from an inside surface of the circumferentially extending portion. Each vane 30 extends between two protrusions of the housing 54, thereby defining an advance region 72 between the vane 30 and one of the two protrusions, and a retard region 70 between the vane 30 and the other of the two protrusions. A cover 56 is coupled to the housing 54 so that each of the housing 54 and the rotor 40 is axially disposed between the cover 56 and the sprocket 50.

The locking pin 16 includes an enlarged-diameter portion 98 at one end, and an axially extending opening 96 formed in the enlarged-diameter portion 98. The axially extending opening 96 receives a compression spring 60. A clip 76 is disposed axially between the cover 56 and the enlarged-diameter portion 98 of the locking pin 16. One end of the compression spring 60 engages the clip 76 and the other end of the compression spring 60 engages an inner surface 94 of the locking pin 16 that is defined by the opening 96. A check ring 58 is disposed within the bore 18 and at least partially extends about the locking pin 16. The thin check ring 58 acts as band-shaped check valve spring which can seal the A-port and B-port passage 26,28 in a backflow direction such that fluid can enter into the locking pin hydraulic chambers but can not flow back into the A-port- and B-port passages 26, 28, as described in U.S. Pat. No. 7,600,531 B thus hydraulically decoupling retard and advance region 70, 72, In an exemplary embodiment, each of the check valves 24*a*, 24*b* illustrated in FIG. 1 is, or includes, the check ring 58 illustrated in FIG. 2*a*. In an exemplary embodiment, the single check ring 58 serves as each of the two check valves 24*a*, 24*b*.

The sprocket 50 includes a recess 64 formed in a face thereof, and a radial slot 66 extending radially outwardly from the recess 64. The sprocket 50 is operably coupled to an output shaft or crankshaft 42 of an internal combustion engine. The sprocket 50 is operably coupled to the crankshaft 42 so that rotation of the crankshaft 42 causes the sprocket 50 to rotate.

The bore 18 is in fluid communication with the on/off control valve 20 via a release fluid passage 32. The release fluid passage 32 includes a circumferentially extending locking control groove 86 formed in the outer surface of the camshaft 42, an axially extending passage formed in the camshaft 42, an axially extending passage formed in the rotor 40, and a radially extending passage 68 formed in the rotor 40.

Each advance region 72 is in fluid communication with the oil control valve 14 via an advance fluid passage 34. Each advance fluid passage 34 includes a common circumferentially extending advance groove 78 formed in the camshaft 42, a common axially extending passage formed in the camshaft 42, and a respective one of a plurality of radially extending passages 68 formed in the center portion 44 of the rotor 40. The advance region 72 adjacent to the vane 30 through which the bore 18 is formed is in fluid communication with the bore 18 via the A-port 26 and the check valve 24*a* proximate to the A-port 26.

Each retard region 70 is in fluid communication with the oil control valve 14 via a retard fluid passage 36. Each retard fluid passage 36 includes a common circumferentially extending retard groove 80 formed in the camshaft 42, a common axially extending passage formed in the camshaft 42, and a respective one of a plurality of radially extending passages 68 formed in the center portion 44 of the rotor 40. The retard region 70 adjacent to the vane 30 through which the bore 18 is formed is in fluid communication with the bore 18 via the B-port 28 and the check valve 24*b* proximate to the B-port 28.

Figure 2A:
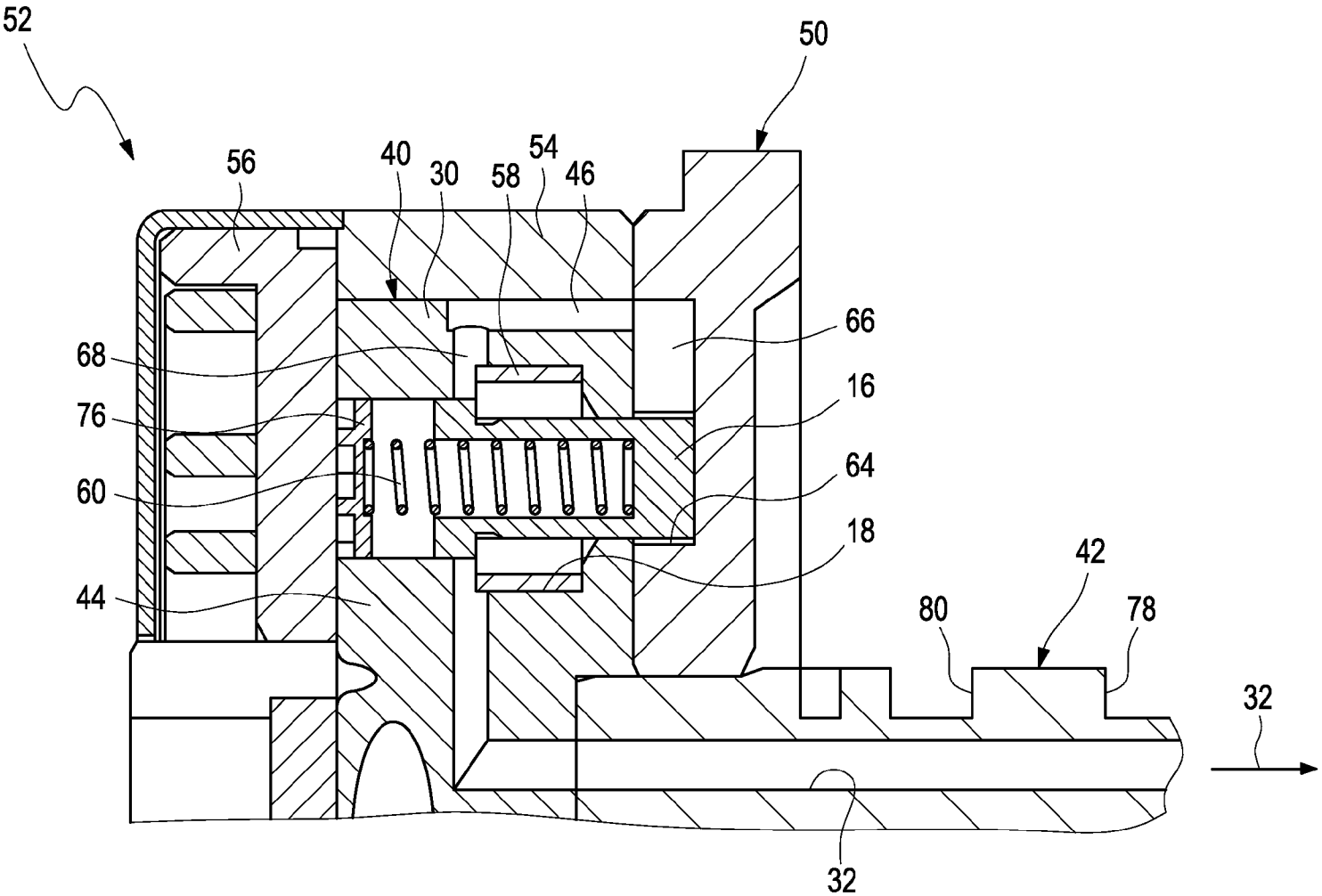
FIG. 2*a* is a sectional view of a portion of the valve timing control apparatus of FIG. 1, according to an exemplary embodiment.
Figure 2B:
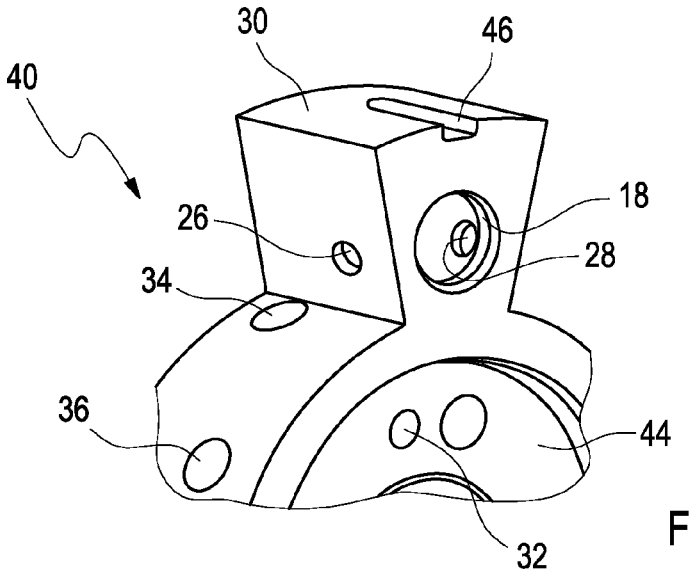
FIG. 2*b* is a perspective view of a portion of the valve timing control apparatus of FIG. 1, according to an exemplary embodiment.
Figure 2C:
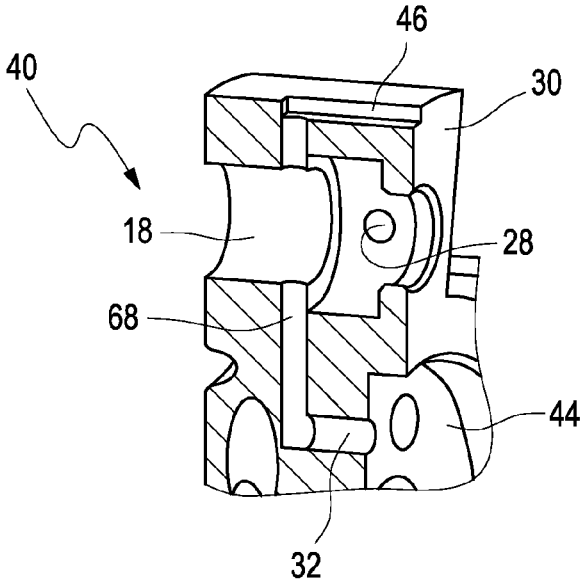
FIG. 2*c* is a perspective sectional view of a portion of the valve timing control apparatus of FIG. 1, according to an exemplary embodiment.
Figure 2D:
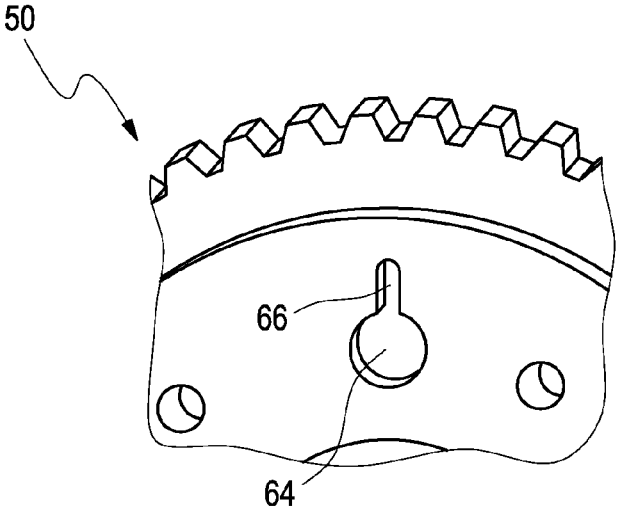
FIG. 2*d* is a perspective view of a portion of the valve timing control apparatus of FIG. 1, according to an exemplary embodiment.

In operation, in an exemplary embodiment, the apparatus 10 illustrated in FIGS. 1-2*d* operates as a cam phasing device, cam phaser 52 or cam phasing system for an internal combustion engine. In several exemplary embodiments, the apparatus 10 controls the opening and closing of intake or exhaust valves of the internal combustion engine, which valves are operably coupled to the camshaft 42. In several exemplary embodiments, the apparatus 10 controls the opening and closing of the intake or exhaust valves in accordance with the operational parameters of the internal combustion engine. In several exemplary embodiments, the apparatus 10 controls the angular phase difference between the crankshaft of the internal combustion engine (to which the sprocket 50 is operably coupled) and the camshaft 42 of the internal combustion engine (to which the rotor 40 is operably coupled). The apparatus 10 controls the angular phase difference between the crankshaft and the camshaft 42 using the oil control valve 14, which supplies hydraulic pressure to the advance regions 72 and/or the retard region 70. In several exemplary embodiments, the apparatus 10 controls the angular phase difference in accordance with the operational parameters of the internal combustion engine. In several exemplary embodiments, the apparatus 10 operates as a variable valve timing (VVT) control apparatus.

During operation, in an exemplary embodiment, the rotor 40 is releasably locked to the sprocket 50, thereby preventing relative rotation between the sprocket 50 and the rotor 40. More particularly, the locking pin 16 extends into the recess 64 formed in the sprocket 50, thereby preventing relative rotation between the sprocket 50 and the rotor 40. In this configuration, the bore 18 is axially aligned with the recess 64, and the axial slot 46 formed in the vane 30 in which the bore 18 is formed is axially aligned with the distal end of the radial slot 66 extending from the recess 64. The spring 60 applies a biasing force against the locking pin 16, urging the locking pin 16 to extend from the bore 18 into the recess 64 formed in the sprocket 50, thereby locking the rotor 40 to the sprocket 50. This activated or locked position of the locking pin 16 is illustrated in FIG. 2*a*. In an exemplary embodiment, the locking pin 16 may extend into the recess 64 formed in the sprocket 50 when, for example, the internal combustion engine is stopped, the internal combustion engine is starting up, and/or at any time the hydraulic pressure supplied by the oil control valve 14 is relatively low. In an exemplary embodiment, the locking pin 16 may extend into the recess 64 formed in the sprocket 50 so that the vane 30 is locked at an intermediate position between the most advanced angle phase position of the vane 30 relative to the housing 54 and the most retarded angle phase position of the vane 30 relative to the housing 54. In an exemplary embodiment, when the locking pin 16 extends into the recess 64 formed in the sprocket 50 and thus the sprocket 50 and the rotor 40 are locked together, the on/off control valve 20 is open. Since the on/off control valve 20 is open, any fluid in the bore 18, recess 64, radial slot 66, axial slot 46, etc. is vented out via the release fluid passage 32.

During operation, in an exemplary embodiment, the rotor 40 is unlocked from the sprocket 50, thereby permitting relative rotation between the sprocket 50 and the rotor 40. More particularly, the oil control valve 14 supplies fluid, such as oil, to the respective advance regions 72 and/or the respective retard regions 70. In an exemplary embodiment, the oil control valve 14 supplies oil to the respective advance regions 72 via the advance fluid passage 34. In an exemplary embodiment, the oil control valve 14 supplies oil to the respective retard regions 70 via the retard fluid passage 36. As a result, in an exemplary embodiment, oil flows from the advance region 72 adjacent to the vane 30 through which the bore 18 is formed, through the port A 26 and the check valve 24*a* proximate thereto (i.e. the check ring 58), into the bore 18. In an exemplary embodiment, in addition to, or instead of, flowing from the advance region 72, oil flows from the retard region 70 adjacent to the vane 30 through which the bore 18 is formed, through the B-port 28 and the check valve 24*b* proximate thereto (i.e., the check ring 58), into the bore 18. The on/off control valve 20 is closed. Since the on/off control valve 20 is closed, fluid in the bore 18, recess 64, radial slot 66, axial slot 46, etc. is not vented out via the release fluid passage 32. As a result, as more oil is supplied into the bore 18 via the A-port and/or B-port, the hydraulic pressure in the bore 18 increases. When the oil pressure in the bore 18 becomes greater than the urging or biasing force of the spring 60, the spring 60 is compressed or further compressed by the locking pin 16, and the locking pin 16 moves out of the recess 64 formed in the sprocket 50, but continues to extend within the bore 18. As a result of this released position, the rotor 40 is unlocked from the sprocket 50. In an exemplary embodiment, the locking pin 16 moves out of or is otherwise released from the recess 64 formed in the sprocket 50 and thus the rotor 40 is unlocked from the sprocket 50 when, for example, the internal combustion engine is in a steady state or in normal operation (i.e., not stopping or starting), and/or at any time the hydraulic pressure in the bore 18 is greater than the urging or biasing force of the spring 60.

During operation, in an exemplary embodiment, the rotor 40 is again releasably locked to the sprocket 50. More particularly, when the locking pin 16 is moved out of or otherwise released from the recess 64 formed in the sprocket 50 and thus the rotor 40 is unlocked from the sprocket 50, the hydraulic pressure in the bore 18 is decreased by opening the on/off control valve 20. Additionally, in several exemplary embodiments, the pressure supplied by the oil control valve 14 is decreased, thereby decreasing the hydraulic pressure in the bore 18. In response to the opening of the on/off control valve 20, oil in the bore 18, the recess 64 formed in the sprocket 50, the radial slot 66 formed in the sprocket 50, the axial slot 46 formed in the vane 30, and the radial passage 68 formed in the rotor 40, vents out to the oil reservoir 22 via at least the release fluid passage 32 and the on/off control valve 20.

When the urging or biasing force applied to the locking pin 16 by the spring 60 is greater than the hydraulic pressure in the bore 18, the spring 60 urges the locking pin 16 back into the recess 64, thereby releasably locking the rotor 40 to the sprocket 50. Since the on/off control valve 20 is open, any fluid in the bore 18, recess 64, radial slot 66, axial slot 46, radial passage 68, etc. is vented out via the release fluid passage 32 and the on/off control valve 20.

During the above-described operation, in an exemplary embodiment, the on/off control valve 20 of the apparatus 10 illustrated in FIGS. 1-2*d* does not supply any hydraulic pressure to the bore 18 at any time, including when the rotor 40 is releasably locked to the sprocket 50, when the rotor 40 is unlocked from the sprocket 50, when the rotor 40 is again releasably locked to the sprocket 50, and any time before, between or after the foregoing configurations.

Figure 3A:
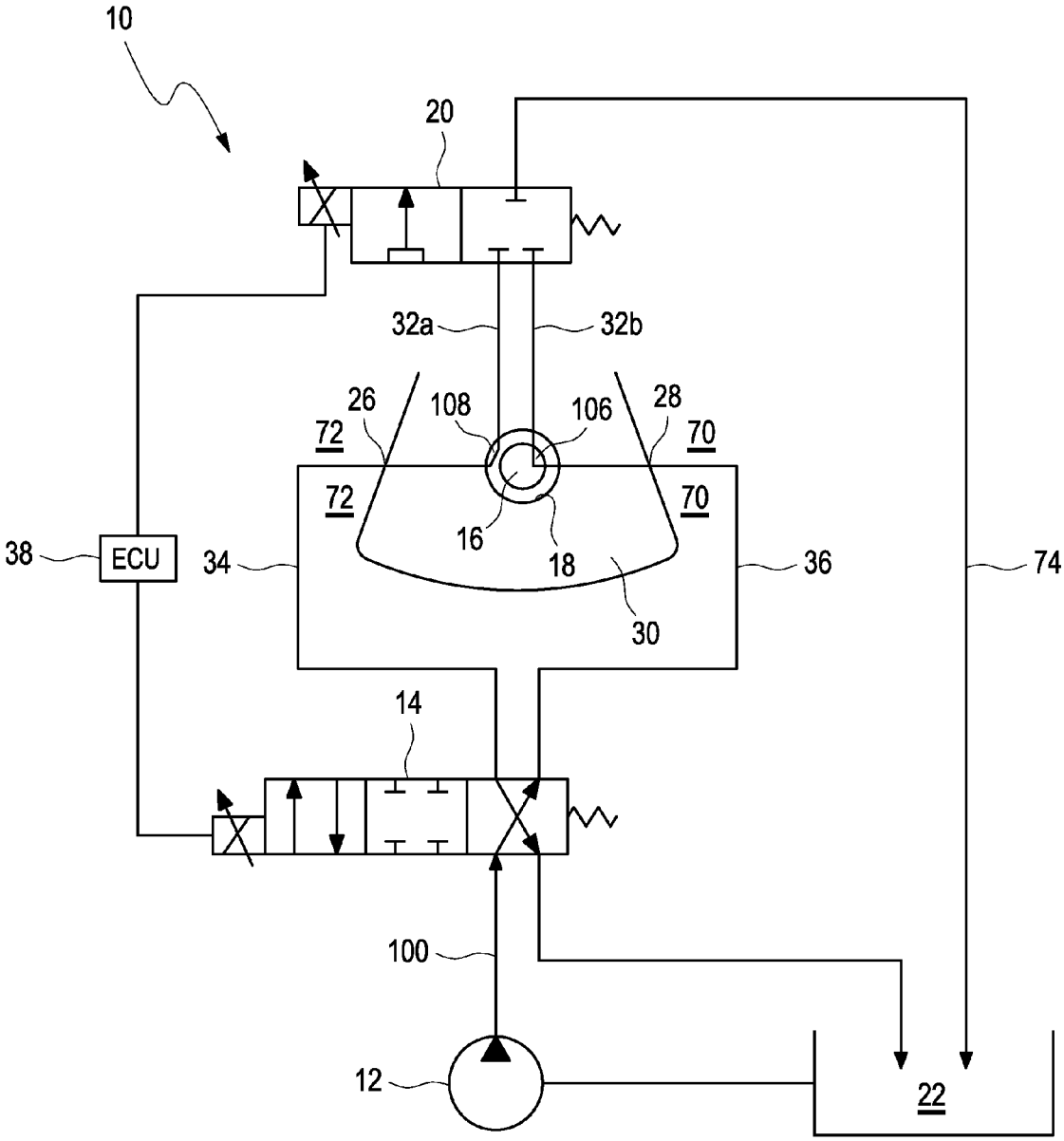
FIG. 3*a* is a diagrammatic illustration of a valve timing control apparatus, according to an exemplary embodiment.
Figure 3B:
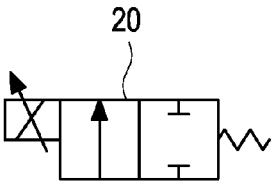
FIGS. 3*b* and 3*c* are diagrammatic illustrations of respective portions of the valve timing control apparatus of FIG. 3*a*, according to respective exemplary embodiments.
Figure 3C:
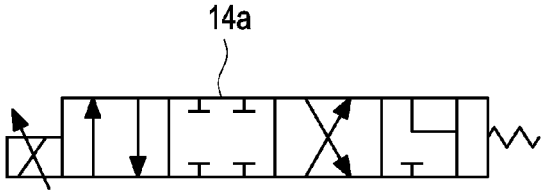

In an exemplary embodiment, as illustrated in FIGS. 3*a*, 3*b* and 3*c* with continuing reference to FIGS. 1, 2*a*, 2*b*, 2*c* and 2*d*, a valve timing control apparatus 10 is provided. The valve timing control apparatus 10 of FIG. 3*a* is similar to that of FIGS. 1, 2*a*, 2*b*, 2*c* and 2*d*, except that the check valves 24*a*, 24*b* are omitted from the apparatus 10 of FIG. 3*a*. And, instead of including a single release fluid passage 32 to the on/off control valve 20, the apparatus 10 of FIG. 3*a* includes two release fluid passages 32*a*, 32*b*, one 32*a* via which one or more of the A-port 26, the bore 18 and the recess 64 are in fluid communication with the on/off control valve 20, and another release fluid passage 32*b* via which one or more of the B-port 28, the bore 18, and the recess 64 are in fluid communication with the on/off control valve 20. In an exemplary embodiment, fluid in the sprocket 50 is drained or vented via one of the release fluid passages 32*a*, 32*b*, and fluid in the bore 18 is drained or vented via the other of the release fluid passages 32*a*, 32*b*. As shown in FIGS. 3*a* and 3*c*, the oil control valve 14 is either a 3-position, 4-way valve, or a 4-position, 4-way proportional valve, see FIG. 3*c*. As shown in FIG. 3*a*, the on/off control valve 20 is a 2-position, 3-way valve. FIG. 3*b* depicts another configuration of said on/off control valve 20 as 2/2 valve. Both valves 14, 20 are structurally and functionally separate from each other thus much cheaper in production and more fail-safe in use as a combined oil control and on/off valve. In FIG. 3*c* the oil control valve 14*a* is a 4/4-proportional valve with a retard position, whereby retard region 70 is pressurized and advance region 72 is vented, an advance position, in which advance region 72 is pressurized and retard region 70 is vented, a block position, wherein the hydraulic system is decoupled from pump 12 and oil reservoir 22 and a complete vent position, wherein the hydraulic system is completely vented, such that rotor 40 in an intermediate position is self-locked by spring force of spring 60 which brings locking pin 16 in a locking position.

In an exemplary embodiment, as illustrated in FIGS. 4*a*-8 with continuing reference to FIGS. 1-3*c*, a valve timing control apparatus 10 is provided and includes a camshaft 42 and a rotor 40 operably coupled thereto. The rotor 40 is operably coupled to the camshaft 42 so that rotation of the rotor 40 causes the camshaft 42 to rotate. The rotor 40 includes a center portion 44 and a plurality of vanes 30 extending radially outwardly therefrom. A bore 18 is formed, and axially extends through one of the vanes 30 in the plurality of vanes 30. An axial slot 46 is formed in the distal surface of the vane 30 through which the bore 18 is formed. A radial slot 84 is formed at the front of the vane 30 through which the bore 18 is formed. The radial slot 84 extends from an end of the axial slot 46 to the bore 18, and further to a notch 90 formed in the front of the center portion 44 of the rotor 40. The axial slot 46, the radial slot and the notch 90 may be considered to be part of a front vent passage 82. The rotor 40 is disposed within a housing 54, which is coupled to a rotational member such as, for example, a sprocket 50. The sprocket 50 is operably coupled to an output shaft or crankshaft of an internal combustion engine. The sprocket 50 is operably coupled to the crankshaft so that rotation of the crankshaft causes the sprocket 50 to rotate.

In an exemplary embodiment, the housing 54 includes a circumferentially extending portion that extends about the rotor 40, and a plurality of protrusions extending radially inwardly from an inside surface of the circumferentially extending portion. Each vane 30 extends between two protrusions of the housing 54, thereby defining an advance region 72 between the vane 30 and one of the two protrusions, and a retard region 70 between the vane 30 and the other of the two protrusions. A cover 56 is coupled to the housing 54 so that each of the housing 54 and the rotor 40 is axially disposed between the sprocket 50 and the cover 56.

Each of the advance regions 72 is in fluid communication with a proportional oil control valve 14 via an advance fluid passage 34. Each advance fluid passage 34 includes a common circumferentially extending advance groove 78 formed in an outer surface of the camshaft 42, a common axially extending advance passage 34 formed in the camshaft 42, and a respective one of a plurality of radially extending passages 68 formed in the center portion 44 of the rotor 40.

Each of the retard regions 70 is in fluid communication with the oil control valve 14 via a retard fluid passage 36. Each retard fluid passage 36 includes a common circumferentially extending retard groove 80 formed in an outer surface of the camshaft 42, a common axially extending retard passage 36 formed in the camshaft 42, and a respective one of a plurality of radially extending passages 68 formed in the center portion 44 of the rotor 40.

An axially extending locking pin 16 extends within the bore 18, and includes an enlarged-diameter portion 98 at one end, an annular channel 92 formed in the outside surface of the locking pin 16 and positioned adjacent to the enlarged-diameter portion 98, and an axially extending opening 96 formed in the enlarged-diameter portion 98. The axially extending opening 96 receives a compression spring 60. A clip 76 is disposed axially between the cover 56 and the enlarged-diameter portion 98 of the locking pin 16. One end of the compression spring 60 engages the clip 76 and the other end of the compression spring 60 engages an inner surface 94 of the locking pin 16 that is defined by the opening 96. The sprocket 50 includes a recess 64 formed in a face thereof, and a radial slot 66 extending radially outwardly from the recess 64.

The bore 18 is in fluid communication with an on/off control valve 20 via a locking control passage 32. The locking control passage 32 includes a circumferentially extending locking control groove 86 formed in an outer surface of the camshaft 42, an axially extending passage formed in the camshaft 42, an axially extending passage formed in the rotor 40, and a radially extending angular passage 68 formed in the rotor 40.

A pump 12 is in fluid communication with the proportional oil control valve 14 by an oil pressure passage 100. The pump 12 pressurizes hydraulic fluid for operating the hydraulic advance/retard cam phaser system and the hydraulic locking pin system. A release passage 32 is in fluid communication with the on/off control valve 20 for venting hydraulic fluid from the hydraulic locking pin system. A reservoir 22, such as an oil reservoir, is in fluid communication with each of the oil control valve 14 and the on/off control valve 20 via an oil return passage 74. Depending on a switching position of said oil control valve 12, the rotor 40 moves in an advance or retard position with respect to said stator. Depending on a switching position of said on/off-valve 20 and in some embodiments also of said oil control valve 12, said locking pin 16 is in a locking or an unlocking position.

In operation, in an exemplary embodiment, the apparatus 10 illustrated in FIGS. 4*a*-7 operates as a cam phasing device, cam phaser 52 or cam phasing system for an internal combustion engine. In several exemplary embodiments, the apparatus 10 controls the opening and closing of intake or exhaust valves of the internal combustion engine, which valves are operably coupled to the camshaft 42. In several exemplary embodiments, the apparatus 10 controls the opening and closing of the intake or exhaust valves in accordance with the operational parameters of the internal combustion engine. In several exemplary embodiments, the apparatus 10 controls the angular phase difference between the crankshaft of the internal combustion engine (to which the sprocket 50 is operably coupled) and the camshaft 42 of the internal combustion engine (to which the rotor 40 is operably coupled). The apparatus 10 controls the angular phase difference between the crankshaft and the camshaft 42 using the oil control valve 14, which supplies hydraulic pressure to the advance regions 72 and/or the retard regions 70. In several exemplary embodiments, the apparatus 10 controls the angular phase difference in accordance with the operational parameters of the internal combustion engine. In several exemplary embodiments, the apparatus 10 operates as a variable valve timing (VVT) control apparatus.

Figure 4A:
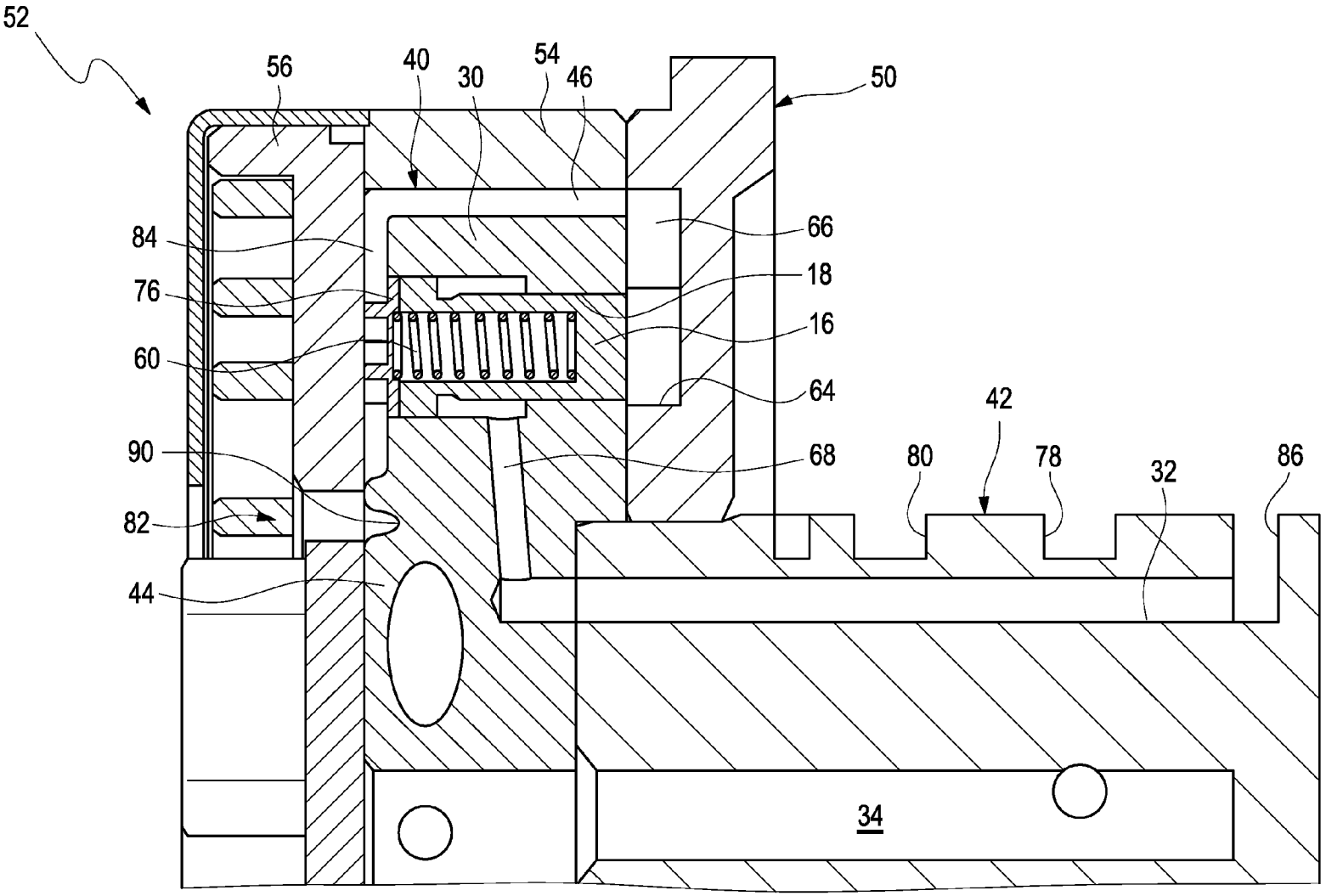
FIG. 4*a* is a sectional view of a valve timing control apparatus, according to an exemplary embodiment.
Figure 4B:
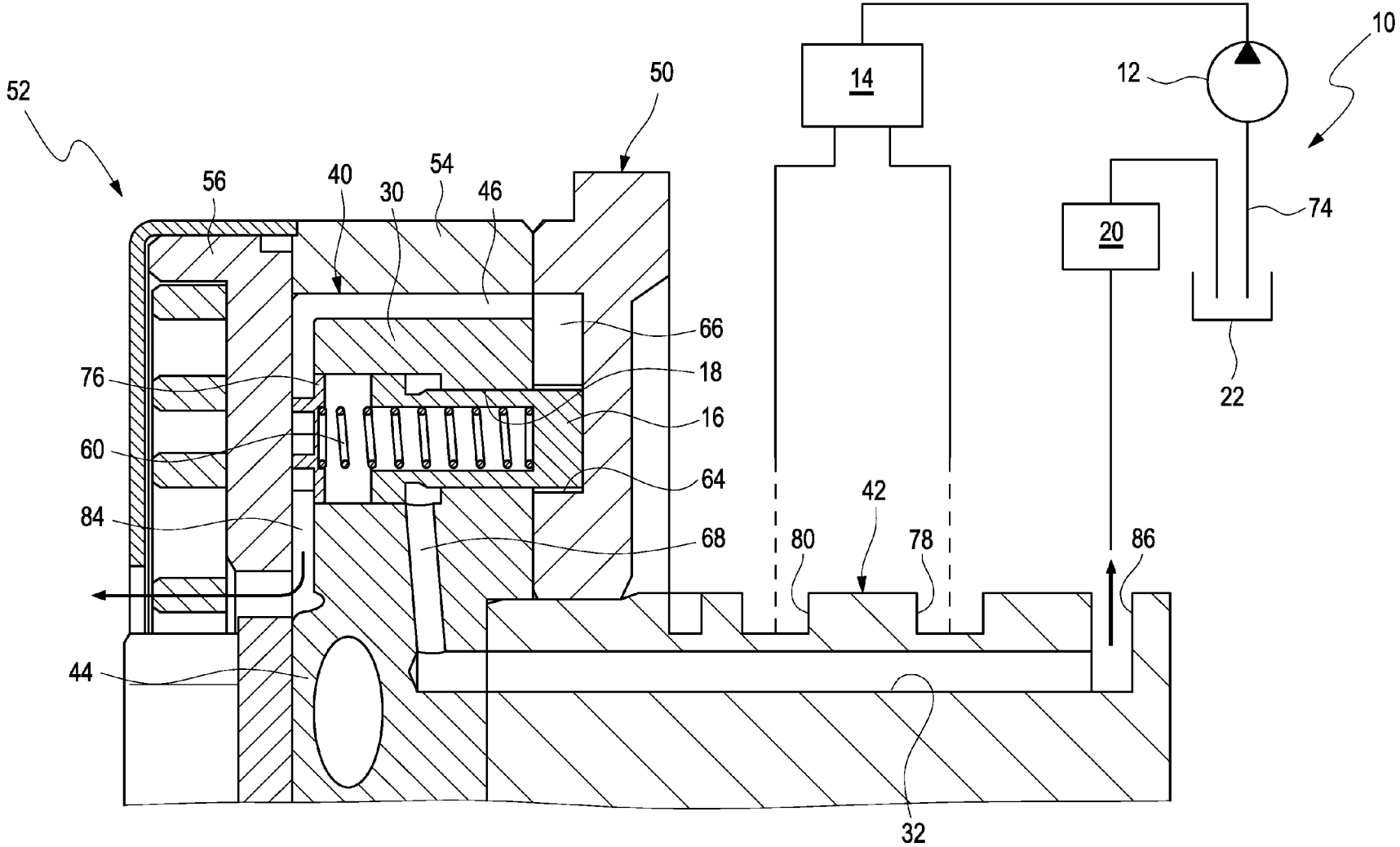
FIG. 4*b* is a partial sectional/partial diagrammatic view of a portion of the valve timing control apparatus of FIG. 4*a*, according to an exemplary embodiment.
Figure 5B:
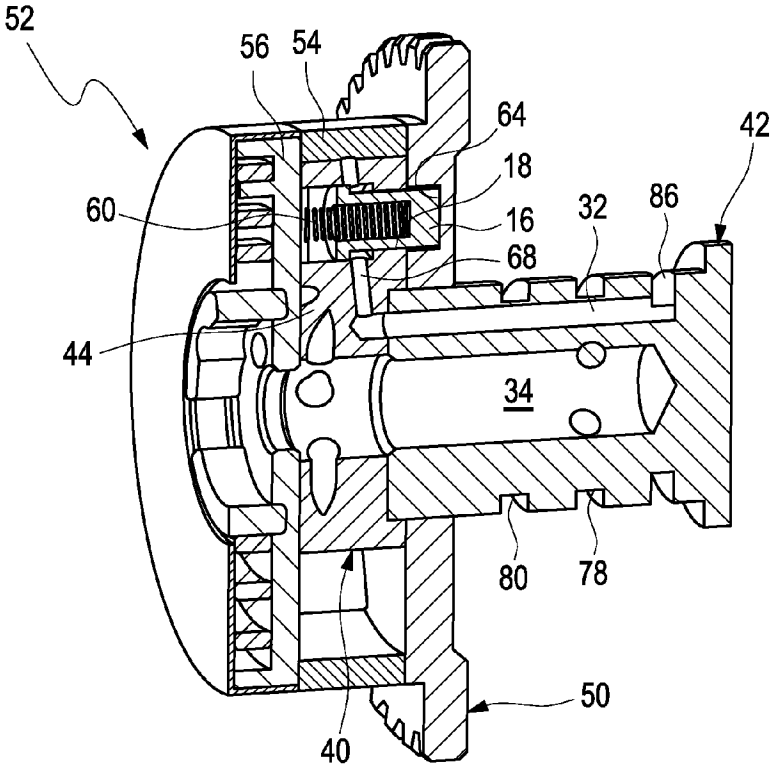
FIGS. 5*a* and 5*b* are sectional views of respective portions of the valve timing control apparatus of FIGS. 4*a*, 4*b* and 4*c*, according to respective exemplary embodiments.
Figure 5A:
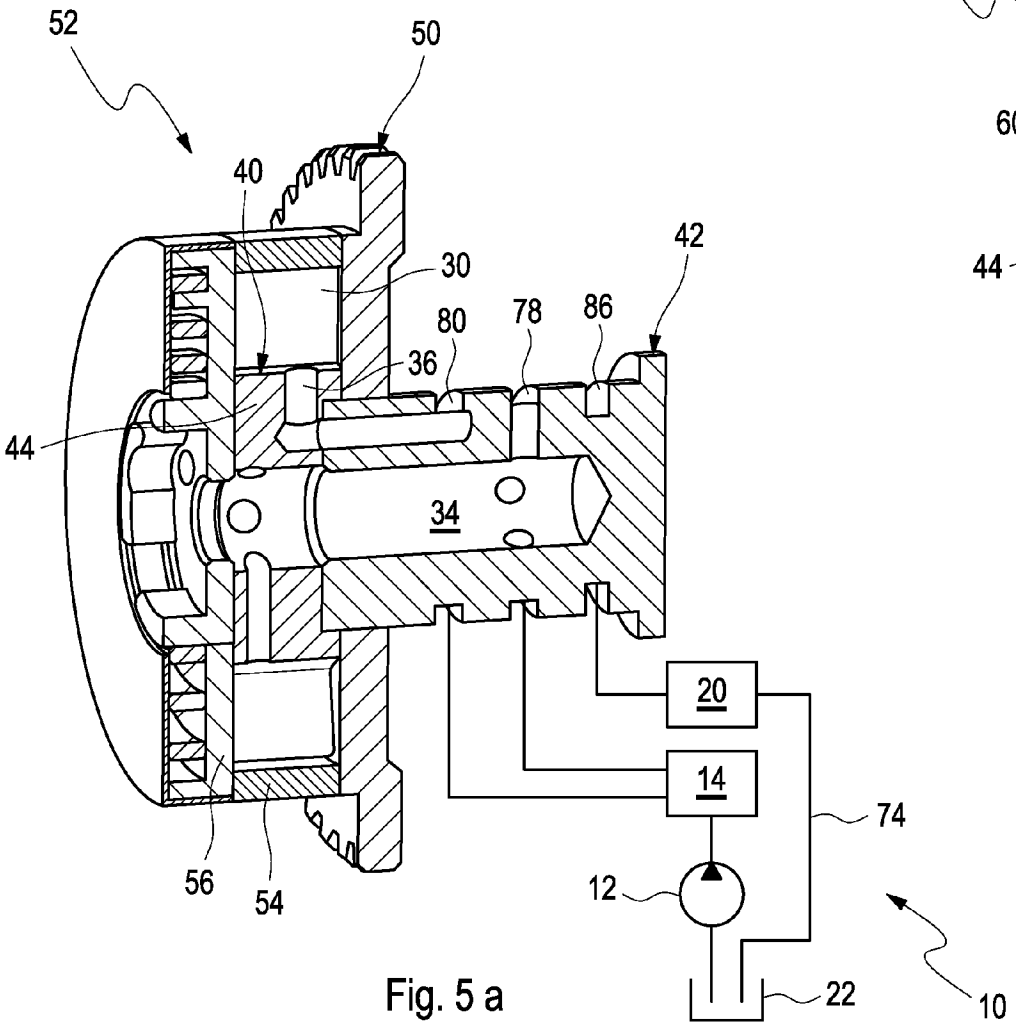
Figure 6B:
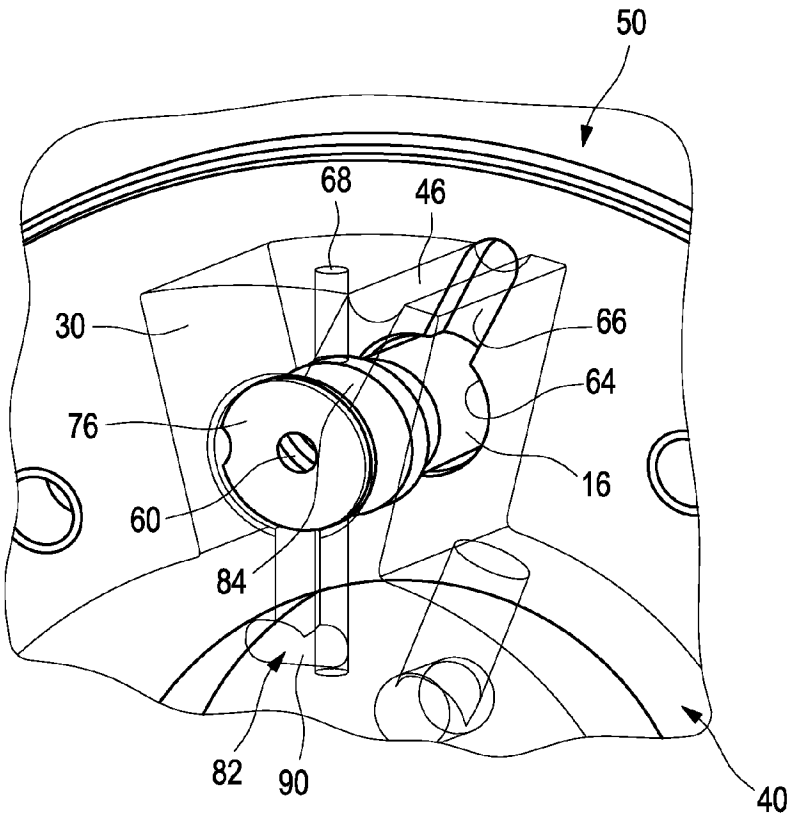
FIGS. 6*a* and 6*b* are perspective views of respective portions of the valve timing control apparatus of FIGS. 4*a*, 4*b*, 5*a* and 5*b*, according to respective exemplary embodiments.
Figure 6A:
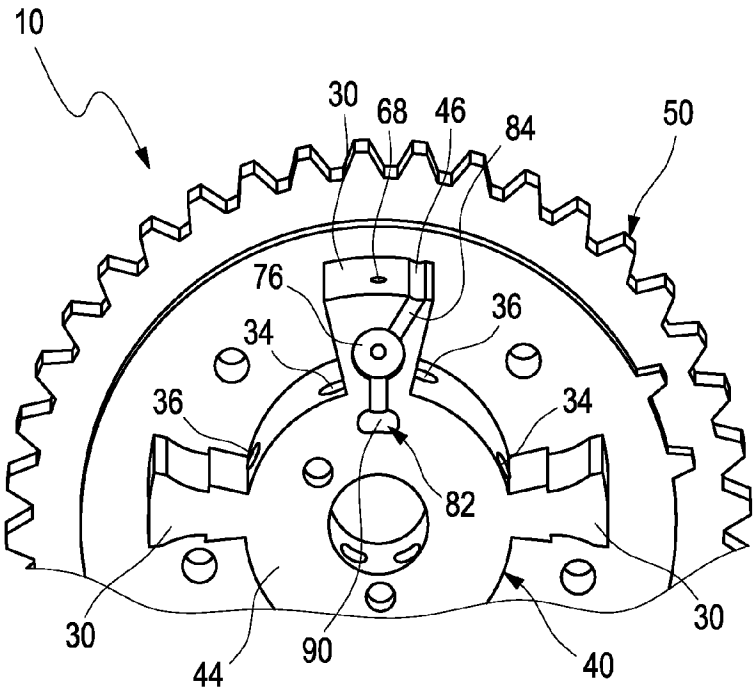
Figure 7:
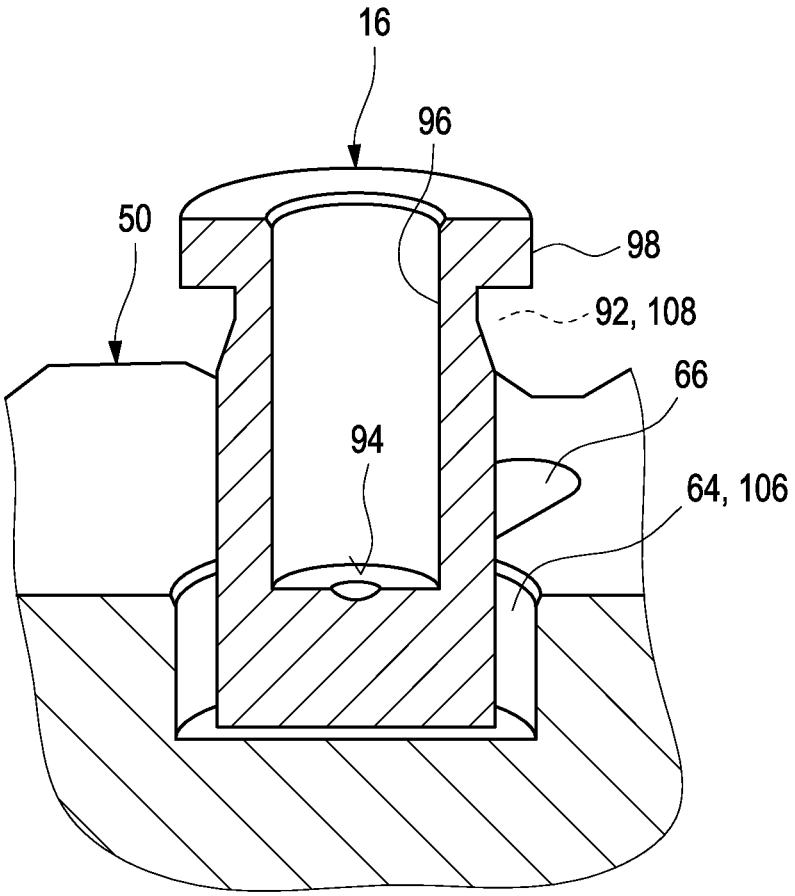
FIG. 7 is a sectional view of a portion of the valve timing control apparatus 10 of FIGS. 4*a*, 4*b*, 5*a*, 5*b*, 6*a* and 6*b*, according to an exemplary embodiment.

During operation, in an exemplary embodiment, the rotor 40 is releasably locked to the sprocket 50, thereby preventing relative rotation between the sprocket 50 and the rotor 40. More particularly, the locking pin 16 extends into the recess 64 formed in the sprocket 50, thereby preventing relative rotation between the sprocket 50 and the rotor 40. In this configuration, the bore 18 is axially aligned with the recess 64, and the axial slot 46 formed in the vane 30 in which the bore 18 is formed is axially aligned with the distal end of the radial slot 66 extending from the recess 64. The spring 60 applies a biasing force against the locking pin 16, urging the locking pin 16 to extend from the bore 18 into the recess 64 formed in the sprocket 50, thereby locking the rotor 40 to the sprocket 50. This activated or locked position of the locking pin 16 is illustrated in FIGS. 4*b* and 5*b*. In an exemplary embodiment, the locking pin 16 may extend into the recess 64 formed in the sprocket 50 and thus locking said rotor 40 with said stator in an intermediate position when, for example, the internal combustion engine is stopped, the internal combustion engine is starting up, and/or at any time the hydraulic pressure supplied by the oil control valve 14 is relatively low. In an exemplary embodiment, the locking pin 16 may extend into the recess 64 formed in the sprocket 50 so that the vane 30 is locked at an intermediate position between the most advanced angle phase position of the vane 30 relative to the housing 54 and the most retarded angle phase position of the vane 30 relative to the housing 54. In an exemplary embodiment, when the locking pin 16 extends into the recess 64 formed in the sprocket 50 and thus the sprocket 50 and the rotor 40 are locked together, the on/off control valve 20 is in an open position and does not supply a hydraulic pressure to the bore 18 via the locking control passage 32. Since the on/off control valve 20 opens said release passage 32 towards said oil reservoir 22, it does not supply a hydraulic pressure to the bore 18 via the locking control passage 32, any fluid in the bore 18 is vented out via the locking control passage (release passage) 32. And any fluid in the recess 64 formed in the sprocket 50, the radial slot 66 formed in the sprocket 50, and the axial slot 46 formed in the vane 30 through which the bore 18 is formed, is vented via the front vent passage 82.

Thus, fluid in the recess 64 and/or the radial slot 66 of the sprocket 50 is vented out separately from the fluid that is vented out from the bore 18 (via the locking control passage 32). Axial slot 46, radial slot 66, and radial slot in vane 84 provide a connection passage 102 between locking ring chamber 108 and locking hole chamber 106 depicted in FIG. 13*a* and following. Since the locking pin 16 extends within the recess 64, the locking pin 16 does not block fluid flow through the radial slot portion 84 of the front vent passage 82. That is, fluid is permitted to flow from the axial slot 46 formed in the vane 30 through which the bore 18 is formed, and to the notch 90 of the front vent passage 82, via which such fluid is vented.

During operation, in an exemplary embodiment, the rotor 40 is unlocked from the sprocket 50, thereby permitting relative rotation between the sprocket 50 and the rotor 40. More particularly, the on/off control valve 20 supplies fluid, such as oil, to the bore 18 via the locking control passage 32. At least a portion of this fluid is disposed in the annular channel 92 of the locking pin 16. As a result, as more oil is supplied to the bore 18 via the locking control passage 32, the hydraulic pressure in the bore 18 increases. When the oil pressure in the bore 18 becomes greater than the urging or biasing force of the spring 60, the spring 60 is compressed or further compressed by the locking pin 16, and the locking pin 16 moves out of the recess 64 formed in the sprocket 50, but continues to extend within the bore 18. As a result of this released position, the rotor 40 is unlocked from the sprocket 50. In an exemplary embodiment, the locking pin 16 moves out of or is otherwise released from the recess 64 formed in the sprocket 50 and thus the rotor 40 is unlocked from the sprocket 50 when, for example, the internal combustion engine is in a steady state or in normal operation (i.e., not stopping or starting), and/or at any time the hydraulic pressure in the bore 18 is greater than the urging or biasing force of the spring 60. In several exemplary embodiments, the hydraulic pressure supplied to the bore 18 by the on/off control valve 20 is different than the hydraulic pressure supplied to the advance regions 72 and/or retard regions 70 by the proportional oil control valve 14.

In an exemplary embodiment, when the rotor 40 is unlocked from the sprocket 50 due to the hydraulic pressure supplied by the on/off control valve 20, oil in the bore 18 and/or the annular channel 92 is not permitted to vent or otherwise drain via the front vent passage 82 because (a) the enlarged-diameter portion 98 of the locking pin 16 and/or the clip 76 prevents the oil disposed in the bore 18 and/or the annular channel 92 on the right hand side of the enlarged-diameter portion 98 (as viewed in FIGS. 4*a*, 4*b*, 5*a* and 5*b*) from flowing across the enlarged-diameter portion 98 and into the axial slot 46 and/or the notch 90 of the front vent passage 82; (b) the locking pin 16 prevents the oil disposed in the bore 18 and/or the annular channel 92 on the right hand side of the enlarged-diameter portion 98 (as viewed in FIGS. 4*a*, 4*b*, 5*a* and 5*b*) from flowing across the locking pin 16 into the recess 64 formed in the sprocket 50; (c) the enlarged-diameter portion 98 of the locking pin 16 and/or the clip 76 prevents oil in the axial slot 46 formed in the vane 30 from flowing through the radial slot 84 formed in the vane 30 and to the notch 90 of the front vent passage 82; and/or any combination thereof.

During operation, in an exemplary embodiment, the rotor 40 is again releasably locked to the sprocket 50. More particularly, when the locking pin 16 is moved out of or otherwise released from the recess 64 formed in the sprocket 50 and thus the rotor 40 is unlocked from the sprocket 50, the pressure supplied by the on/off control valve 20 is decreased, thereby rapidly decreasing the hydraulic pressure in the bore 18. In response, oil in the bore 18 and/or the annular channel 92 vents out to the oil reservoir 22 via at least the locking control passage 32 and the on/off control valve 20. And oil in the recess 64, the radial slot 66 formed in the sprocket 50, the axial slot 46 formed in the vane 30, and the radial slot 84 formed in the vane 30, vents out via at least the notch 90 of the front vent passage 82, separately from the venting of the oil in the bore 18 and/or the annular channel 92. When the urging or biasing force applied to the locking pin 16 by the spring 60 is greater than the hydraulic pressure in the bore 18, the spring 60 urges the locking pin 16 back into the recess 64, thereby releasably locking the rotor 40 to the sprocket 50.

During the above-described operation, in an exemplary embodiment, the on/off control valve 20 of the apparatus 10 illustrated in FIGS. 4*a*, 4*b*, 5*a*, 5*b*, 6*a*, 6*b* and 7 supplies a hydraulic pressure to the bore 18 when the rotor 40 is unlocked from the sprocket 50, but does not supply a hydraulic pressure to the bore 18 when the rotor 40 is releasably locked to the sprocket 50.

Figure 8:
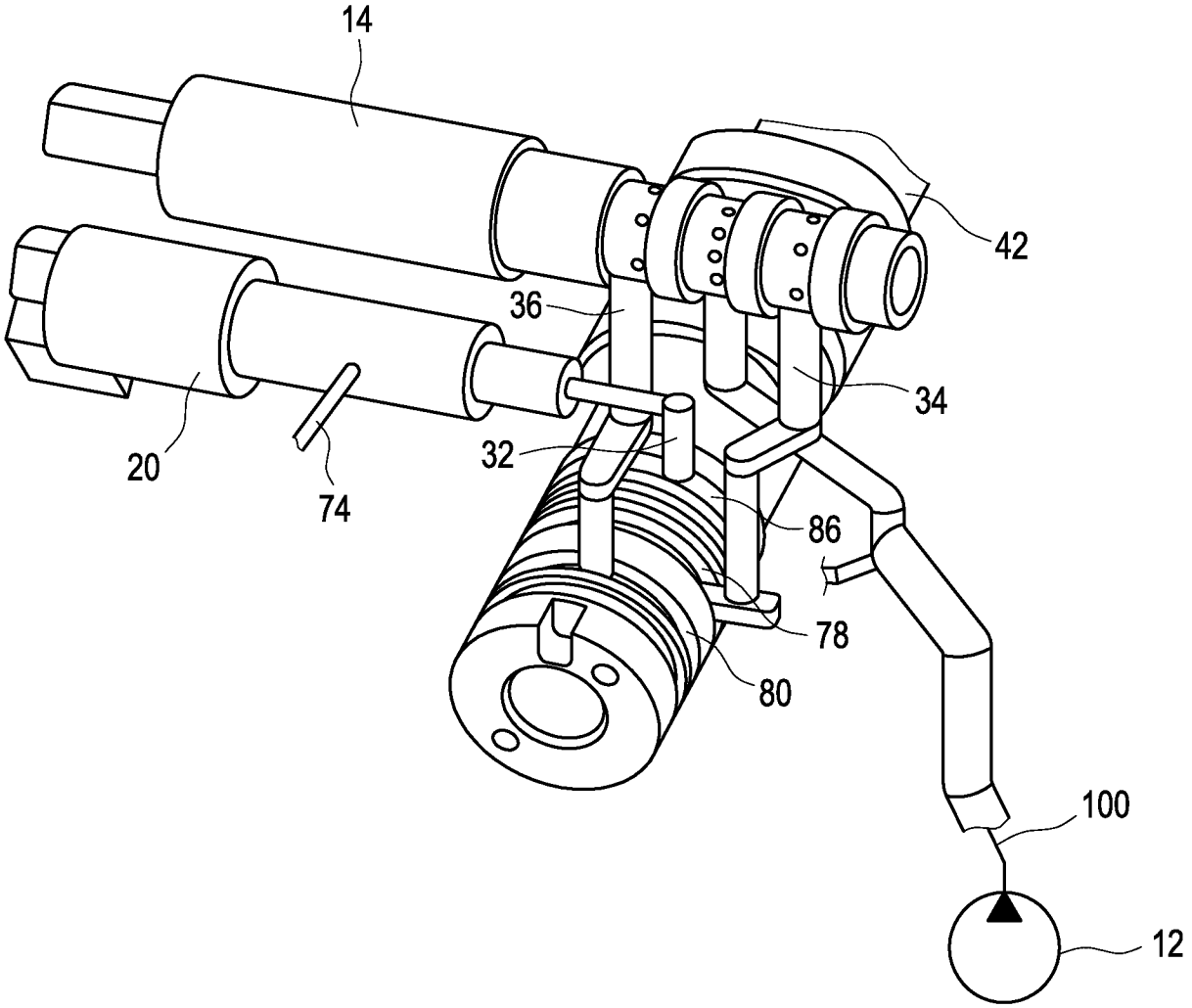
FIG. 8 is a perspective view of a portion of the valve timing control apparatus 10 of FIGS. 4*a*, 4*b*, 5*a*, 5*b*, 6*a*, 6*b* and 7, the portion including an on/off control valve and an oil control valve, according to respective exemplary embodiments.

In an exemplary embodiment, FIG. 8 illustrates an on/off control valve 20 and a proportional oil control valve 14. In an exemplary embodiment, the on/off control valve 20 and the oil control valve 14 illustrated in FIG. 8 is the on/off control valve 20 and the oil control valve 14, respectively, of the apparatus 10 of FIGS. 4*a*, 4*b*, 5*a*, 5*b*, 6*a*, 6*b* and 7. In an exemplary embodiment, the on/off control valve 20 and the oil control valve 14 illustrated in FIG. 8 is the on/off control valve 20 and the oil control valve 14, respectively, of the apparatus 10 of FIGS. 1, 2*a*, 2*b*, 2*c* and 2*d*. In an exemplary embodiment, the on/off control valve 20 and the oil control valve 14 illustrated in FIG. 8 is the on/off control valve 20 and the oil control valve 14, respectively, of the apparatus 10 of FIG. 3*a*.

Figure 9:
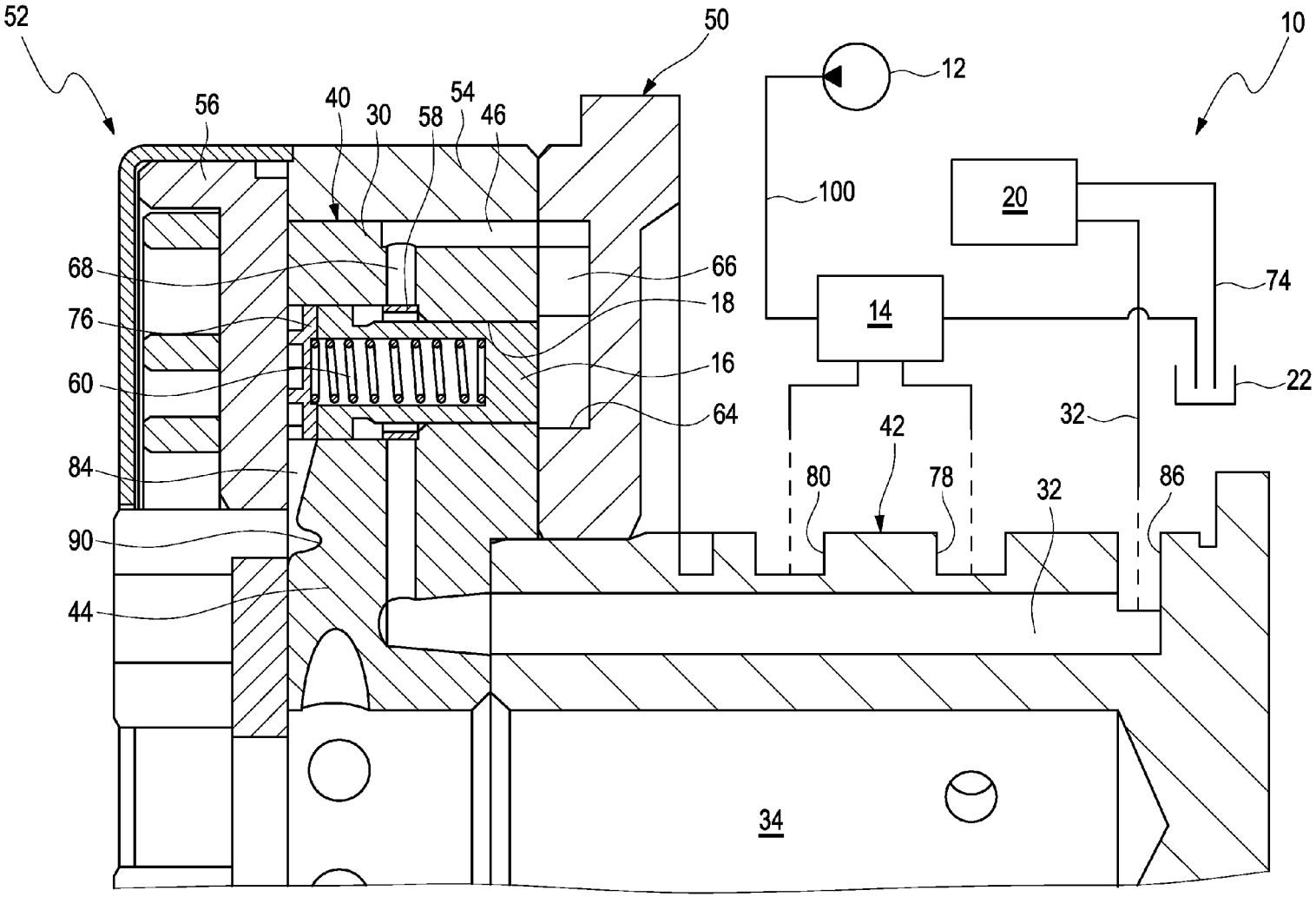
FIG. 9 is a partial sectional/partial diagrammatic view of a valve timing control apparatus, according to an exemplary embodiment.

In an exemplary embodiment, as illustrated in FIG. 9 within continuing reference to FIGS. 1-8, a valve timing control apparatus 10 is provided. The valve timing control apparatus 10 of FIG. 9 is similar to the valve timing control apparatus 10 of FIGS. 4*a*-7, except that the radially extending passage 68 formed in the center portion 44 of the rotor 40, which is part of the locking control passage 32, is not angled as illustrated in FIGS. 4*a*, 4*b*, 5*a* and 5*b*. Instead, as illustrated in FIG. 9, the radially extending passage 68 formed in the center portion 44 of the rotor 40, which is part of the locking control passage 32, is perpendicular to the axially extending passage formed in the rotor 40 and the axially extending passage formed in the camshaft 42, each of which is part of the locking control passage 32.

Figure 10A:
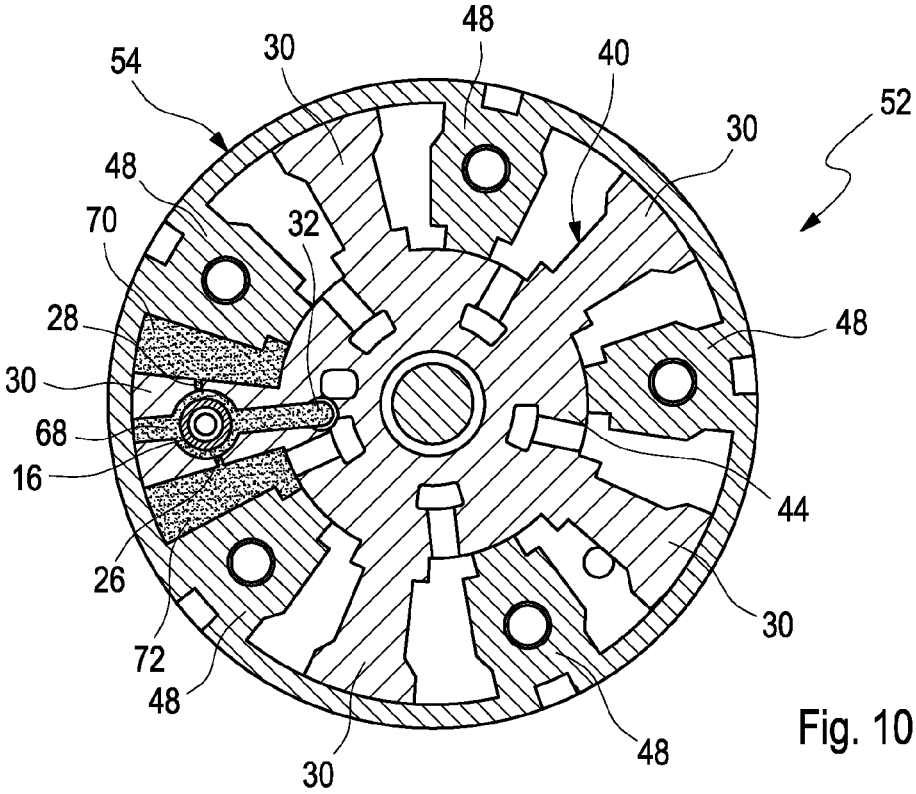
FIGS. 10*a* and 10*b* are cross- and length-sectional views, respectively, of a valve timing control apparatus, according to a further embodiment.
Figure 10B:
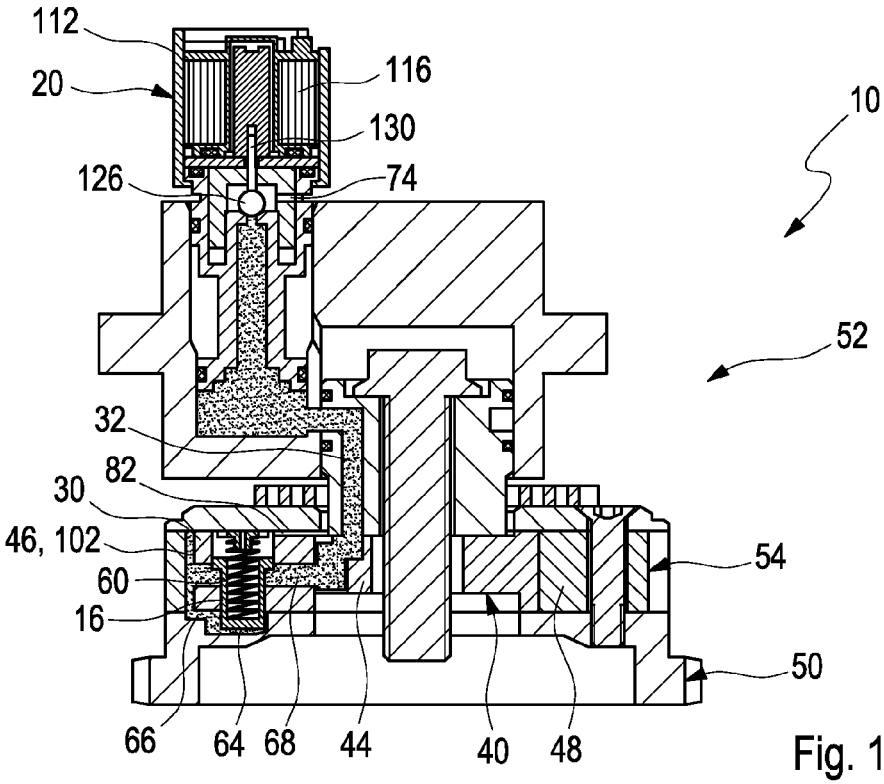

FIG. 10*a* depicts a cross-sectional view of a cam phaser 52 including a rotor 40 and a stator with a stator housing 54. Furthermore, FIG. 10*b* shows a length sectional view of a valve timing control apparatus 10 according to an embodiment. The cam phaser 52 includes a rotor 40 with five vanes 30, whereby one vane includes a locking pin 16 which is hydraulically coupled with an advance region 72 and a retard region 70 providing a hydraulic chamber between lateral walls of said vane 30 and division bars 48 of the stator housing 54. The rotor 40 is rotatably coupled with the camshaft 42 at the center portion 44 of the rotor 40. The locking pin 16 can lock the rotor 40 in an intermediate—providing an advance region 72 and a retard region 70 with identical or different chamber volume. Both regions 70, 72 are hydraulically coupled with an hydraulic release and locking mechanism of the locking pin 16 by an A-port 26 and a B-port 28 for supplying hydraulic fluid for releasing said locking pin 16. The hydraulic fluid of the locking pin 16 is coupled downstream by a release passage 32 to an on/off control valve 20 which is depicted in FIG. 10*a* and FIG. 10*b*. The locking pin 16 is axially aligned with rotor 40 and the camshaft 42, whereby hydraulic fluid flowing from retard region 70 or advance region 72 to the locking pin 16 is fluidly connected by a connecting passage 102 between the locking ring chamber and the locking hole chamber. A front vent passage 82 is provided for air-venting and depressurizing the locking pin hydraulic system. Downstream from the radial passage hydraulic fluid flows through a release passage 32 to an on/off control valve 20 in a valve housing 112, including a valve coil 116, a valve ball 126 and a pintle 130. The on/off control valve 20 is attached to an outer housing of the valve timing control apparatus 10 and is in fluid communication via the release passage 30 with the locking pin 16. The stator housing 54 is rotatably connected with a sprocket 50 which is driven by a belt from a crankshaft of said combustion engine.

Figure 11A:
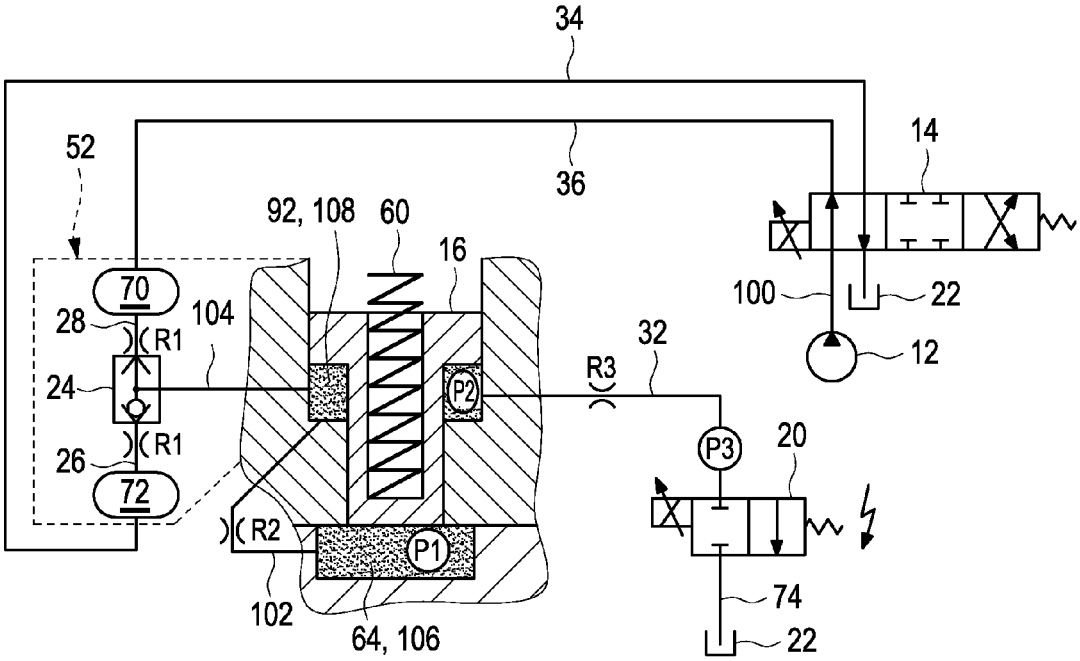
FIGS. 11*a* and 11*b* are diagrammatic illustrations of a hydraulic system for controlling the apparatus of FIGS. 10*a* and 10*b;*
Figure 11B:
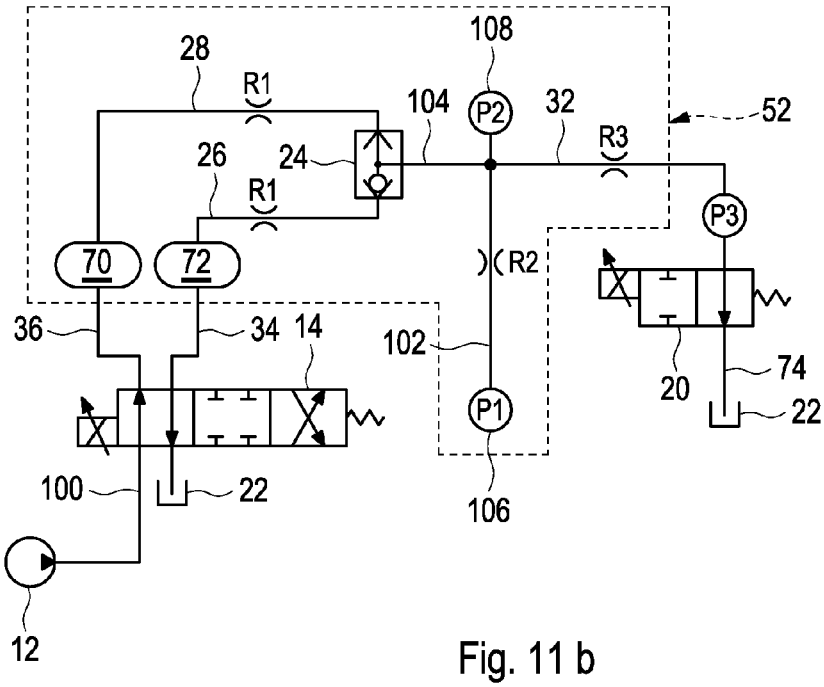

FIGS. 11*a* and 11*b* show a block-diagram of a hydraulic system for controlling of a locking pin 16 of the embodiment of a valve timing control apparatus 10 displayed in FIGS. 10*a* and 10*b*. FIG. 11*a* displays a block-diagram showing a hydraulic system for operating the locking pin 16 which is connected to the hydraulic system for cam phasing the rotor 40 with respect to the stator housing 54. A pump 12 provides pressurized hydraulic fluid in a pressure passage 100, whereby an oil control valve 14 is arranged for switching between an advance and retard phasing or a neutral position of the rotor 40 with respect to the stator housing 54. An advanced and retard passage 34, 36 connects oil control valve 14 with a retard region 70 and an advance region 72, which is included in the phaser 52 for changing the relative position of a vane 30 with respect to division bars 48 of the stator 54. Both chambers 70, 72 are in fluid communication with a locking pin activation passage 104 through an A-port and B-port 26, 28 including an orifice with a flow resistance R1, which is sufficiently large such that only a comparatively small amount of hydraulic fluid can flow from the advance to the retard region 70, 72. When pressurizing one of both chambers 70, 72, a pressurized hydraulic fluid flows through the locking pin activation passage 104 to an annular channel 92 defined by the enlarged diameter of the locking pin 16 for lifting the locking pin 16 in a released position. A connecting passage 102 between locking ring chamber 108 and locking hole chamber 106 and recess 64 in sprocket 64, which defines partly said locking hole chamber 106, allows pressurized fluid to also pressurize the locking hole chamber 106 such that both chambers 106, 108 actively move the locking pin 16 in a released position freeing movement of the rotor 40 against the stator housing 54. The on/off control valve 20 is fluidly connected with the locking ring chamber 108 by a release passage 32 having a flow resistance R3 defined by an orifice. The on/off valve 20 allows switching of the locking pin 16 between a released and locked position. A compression spring 60 is housed by the inner cylinder of the locking pin 16 such that when opening the on/off valve 20 or in a pressureless state, the locking pin 16 is moved to a locking position. Hydraulic fluid flowing through the release passage 32 and the on/off valve 20 is guided through an oil return passage 74 to an oil reservoir 22.

In FIG. 11*b* a block-diagram displays the hydraulic schematic illustration of the configuration shown in FIG. 11*a*. FIG. 11*a* displays a release position of locking pin 16, whereby locking pin hydraulic system is pressurized by switching on/off control valve 20 in an on-position. The oil pump 12 provides a hydraulic pressurized fluid which can be switched by a 4-port 3-position proportional oil control valve 14 which is in fluid communication with A-port 26 and B-port 28, wherein check valves 24, designed as shuttle valve in combination with an orifice with a sufficient large flow resistance R1 in contrast to orifice R3 of release passage 32 prevent a backward flowing or a fluid communication between both regions 70, 72. Thus the pressurized fluid is guided by a locking pin activation passage 104 to the locking pin 16, wherein pressure is installed in locking ring chamber 108 (P2) and locking hole chamber 106 (P1). The hydraulic fluid in both chambers 106, 108 can be guided through a release passage 32 to an on/off control valve 20, which is displayed in an active position, disconnecting release passage 32 from oil release passage 74. In a passive switching position, e.g. the coil of valve 20 is not electrically powered, hydraulic fluid can flow from locking hole chamber 106 and locking ring chamber 108 through release passage 32 and on/off control valve 20 and can return to an oil reservoir 22 through oil return passage 74. The on/off control valve 20 is designed as being open, connecting release passage 32 with oil return passage 74 in a passive switching position and disconnecting release passage from oil return passage 74 in an active switching position. The oil supply of the locking pin 16 is realized by an inlet hole with flow resistance R1 from A-port passage 26 and B-port passage 28 to locking ring chamber 108. This can be realized with or without a check valve 24 behind the inlet hole being depicted as orifice R1. The on/off control valve 20 vents the locking hole chamber 106 whereafter the locking pin 16 locks. When the on/off control valve 30 closes oil flow through the orifice R1, locking hole chamber 106 and the locking ring chamber 108 lifts the locking pin 106 if advance- or retard passage 26, 28 are pressurized by oil control valve 14. It should be noted that the vent oil flow and the flow through orifice R1 must flow through the release passage 32 and the orifice R3. Therefore a pressure drop of the orifice R3 plus the pressure drop of the on/on control valve 20 have to be minimized. If the pressure drop of the orifice R3 plus the pressure drop of the on/off control valve 20 is larger than 0.3 bar, the locking pin 16 would not lock. The pressure drop of the vent oil flow of the release passage 32 and the inlet holes are sensitive parameters for locking said locking pin 16.

Figure 12A:
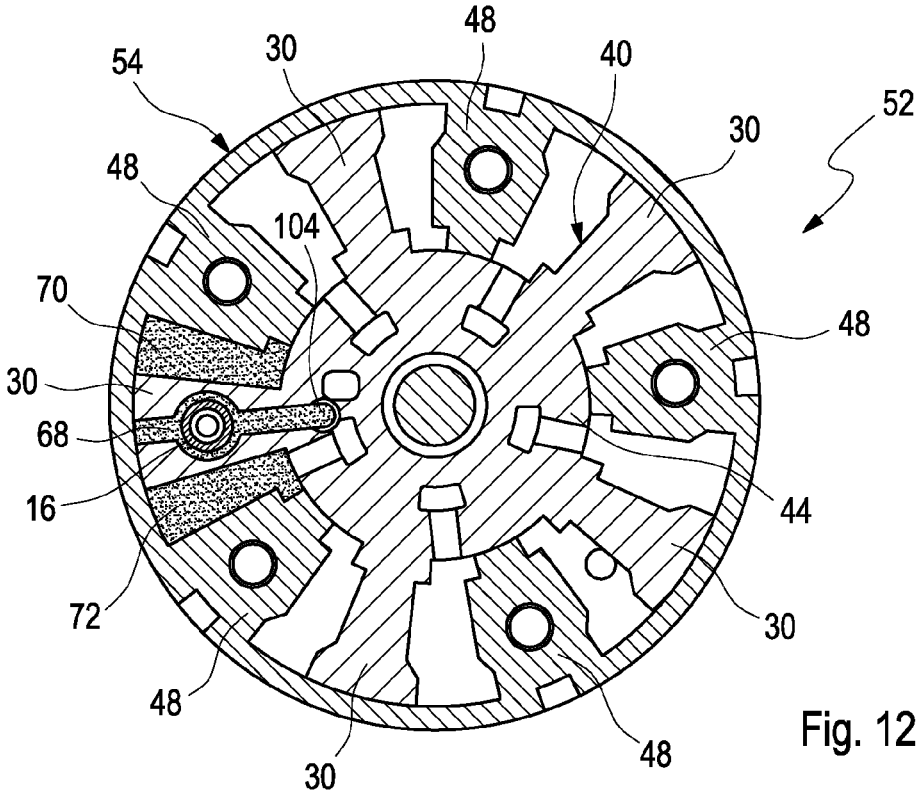
FIGS. 12*a* and 12*b* are cross- and length-sectional views, respectively, of a valve timing control apparatus, according to a further embodiment.
Figure 12B:
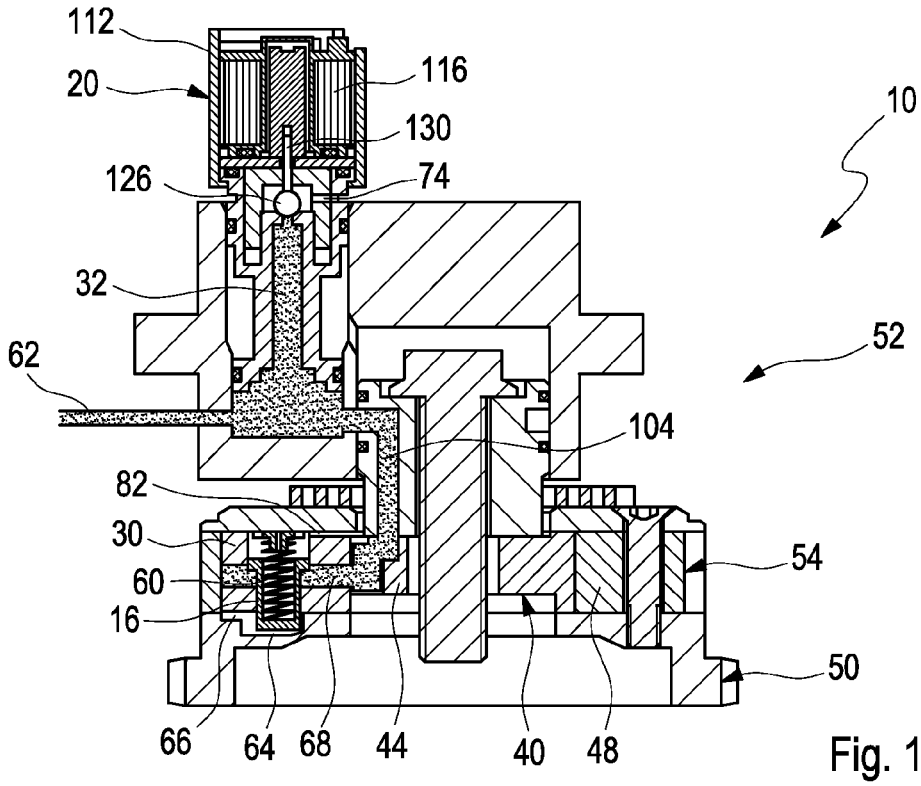

FIG. 12*a* shows a cross-sectional view, and FIG. 12*b* shows a length-sectional view, of another embodiment of a valve timing control apparatus 10 reflecting the structural design of the embodiments depicted in FIGS. 13*a* to 17. In contrast to the embodiment shown in FIGS. 10*a*, 10*b*, 11*a* and 11*b*, this embodiment does not provide a direct fluid communication between the advance and retard region 70, 72 and the locking pin 16 but the hydraulic system for activating the locking pin 16 uses separate hydraulic passages which are hydraulically decoupled from the advance and retard passage 70, 72, according to one of the embodiments shown in FIGS. 13*a* to 15*b*. The hydraulic fluid of the locking pin 16 is coupled downstream by a locking pin activation passage 104 to a release passage 32 and a locking pin supply passage 62, which is depicted in FIG. 10*a* and FIG. 10*b*.

Figure 13A:
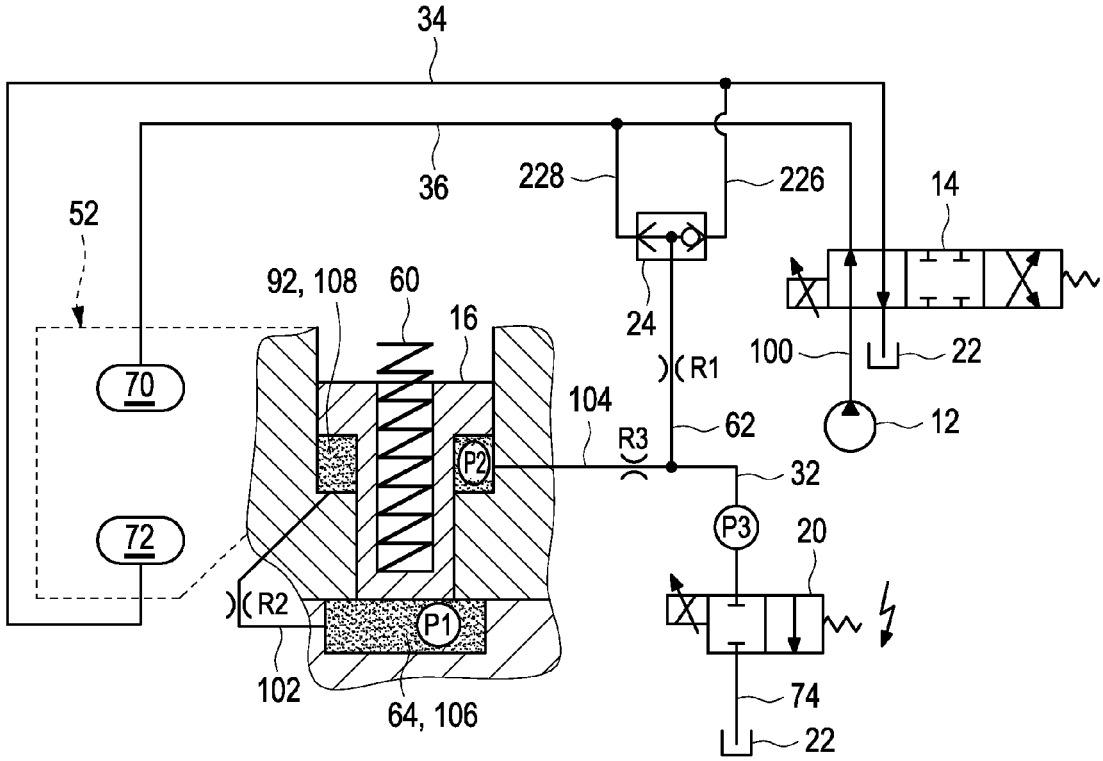
FIGS. 13*a* and 13*b* are diagrammatic illustrations of an embodiment of a hydraulic system for controlling the apparatus of FIGS. 12*a* and 12*b;*
Figure 13B:
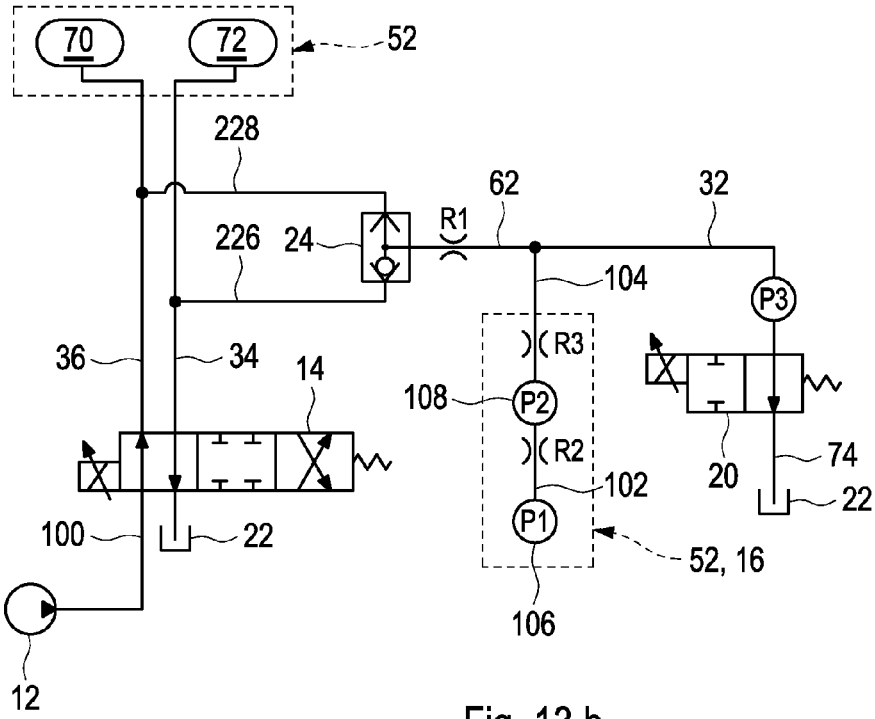

FIGS. 13*a* and 13*b* show similar schematic illustrations as FIGS. 11*a* and 11*b*, respectively, for explaining the hydraulic system of the locking pin 16 shown in the embodiment of FIGS. 12*a* and 12*b*. The hydraulic system for advancing and retarding the cam phase is identical to the schematic illustrations shown in FIGS. 11*a* and 11*b*. From the advance passage 34 and retard passage 36, an A-locking pin supply passage 226 and a B-locking pin supply passage 228 are sidelined and are both connected to a shuttle valve 24, which may also be substituted by two check valves. The output of the shuttle valve 24 is guided through a locking pin supply passage 62 and to a locking pin activation passage 104 to the locking pin 16. The locking pin activation passage 104 has a flow resistance R3 which is very much smaller than the flow resistance R1 of the locking pin supply passage 62 or of the A- and B-locking pin supply passages 226, 228. An on/off control valve 20 is connected to the connection point of the locking pin supply passage 62 and the locking pin activation passage 104 by a release passage 32. By opening or closing the 2/2-on/off control valve 20, the locking pin 16 can be released or locked, if pressure is supplied by oil control valve 14. The on/off control valve 20 is connected to an oil reservoir 22 by an oil return passage 74.

FIG. 13*b* shows a schematic illustration of the layout of FIG. 13*a*. Thereby, the shuttle valve is displayed as two check valves 24 which prevent hydraulic liquid from flowing from the advance passage 34 to the retard passage 36 and vice versa. The pressure indication P3 indicates the pressure in front of the on/off control valve 20. The oil supply of the locking pin 16 is realized by two separate locking pin supply passages 226, 228 to the shuttle valve 24. An orifice for flow restriction is necessary in the two passages 226, 228 to the shuttle valve or alternatively a single orifice R1 can be provided as depicted in FIG. 13*a*. In the case of a closed on/off control valve 20 the oil flow from A-locking pin supply passage 226 and B-locking pin supply passage 228 through the vent release passage 32 to the locking pin 16 will lock the locking pin 16. In case of locking the on/off control valve 20 has to be open. Then the vent oil flow from the locking ring chamber 108 and the oil flow from the locking hole chamber 106 will flow through the release passage 32 and leads the hydraulic fluid which is supplied by the shuttle valve 24 behind the rotary oil feeding system (in front of camshaft 42). Both oil flows will flow through the release passage 32 through the on/off control valve 20. Only the vent oil flow of the locking chambers 106, 108 must flow through the locking pin activation passage 104. Therefore the flow resistance of the locking pin activation passage 104 is not sensitive and the external connection of A- and B-locking pin supply passages 226, 228 with the release passage 32 requires more constructional space. Said increased need of space makes it possible to design other concepts of check valves or orifices. For example it is not necessary to design a 0.5 millimeter orifice. The increased amount of available space allows a cascade of larger orifices. Therefore, the system will increase in robustness of design.

Figure 14A:
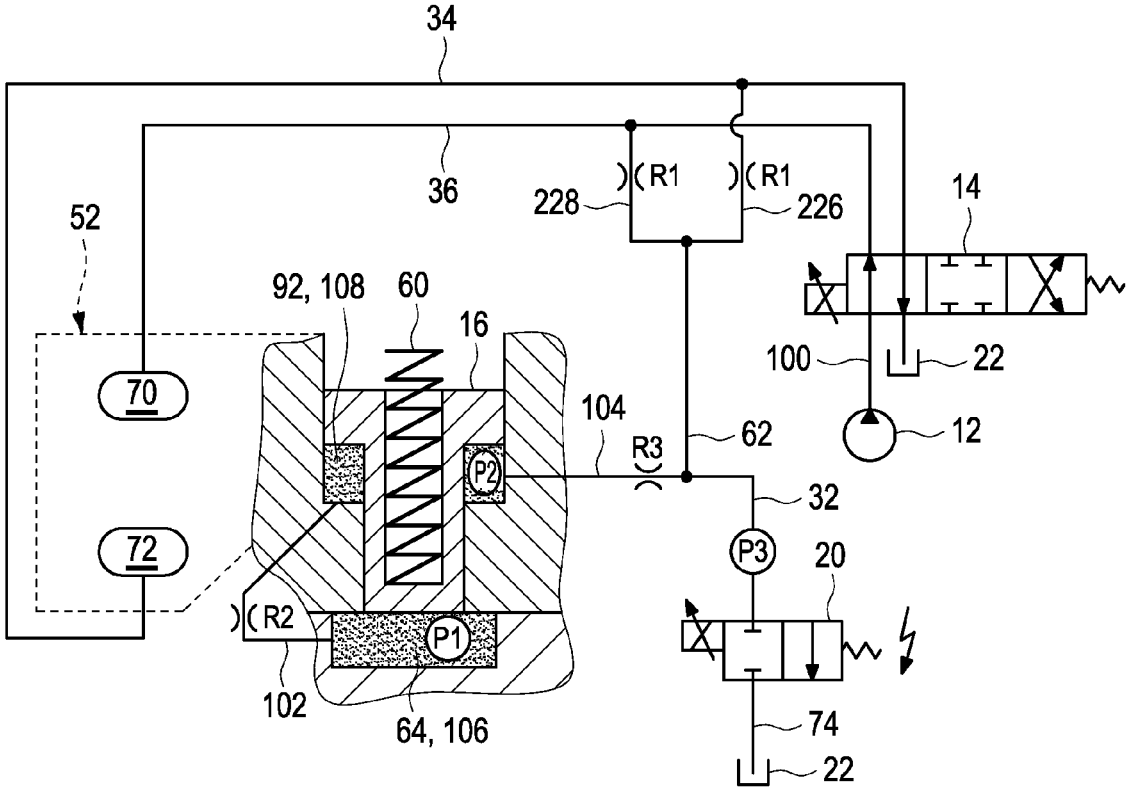
FIGS. 14*a* and 14*b* are diagrammatic illustrations of another embodiment of a hydraulic system for controlling the apparatus of FIGS. 12*a* and 12*b;*
Figure 14B:
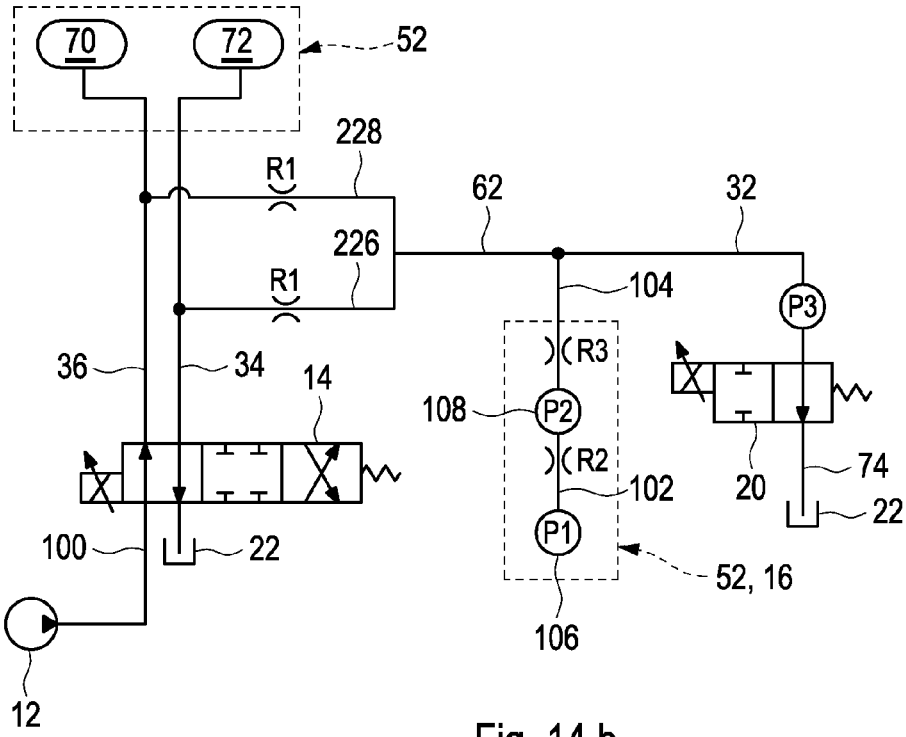

FIGS. 14*a* and 14*b* show in similar schematic views as FIGS. 13*a* and 13*b* another embodiment of a valve timing control apparatus 10. The overall concept of FIGS. 14*a* and 14*b* is identical to the concept of FIGS. 13*a* and 13*b* with the exception that a shuttle valve 24 is not necessary. Therefore the orifice R1 needs to have a flow resistance which needs to be much larger than the flow resistance R3 of the locking pin activation passage 104. According to this embodiment, an additional leakage between A-locking pin supply passage 226 and B-locking pin supply passage 228 is provided but the constructional burden of providing a check valve or a shuttle valve 24 is omitted such that constructional effort is minimized and robustness is increased.

Figure 15A:
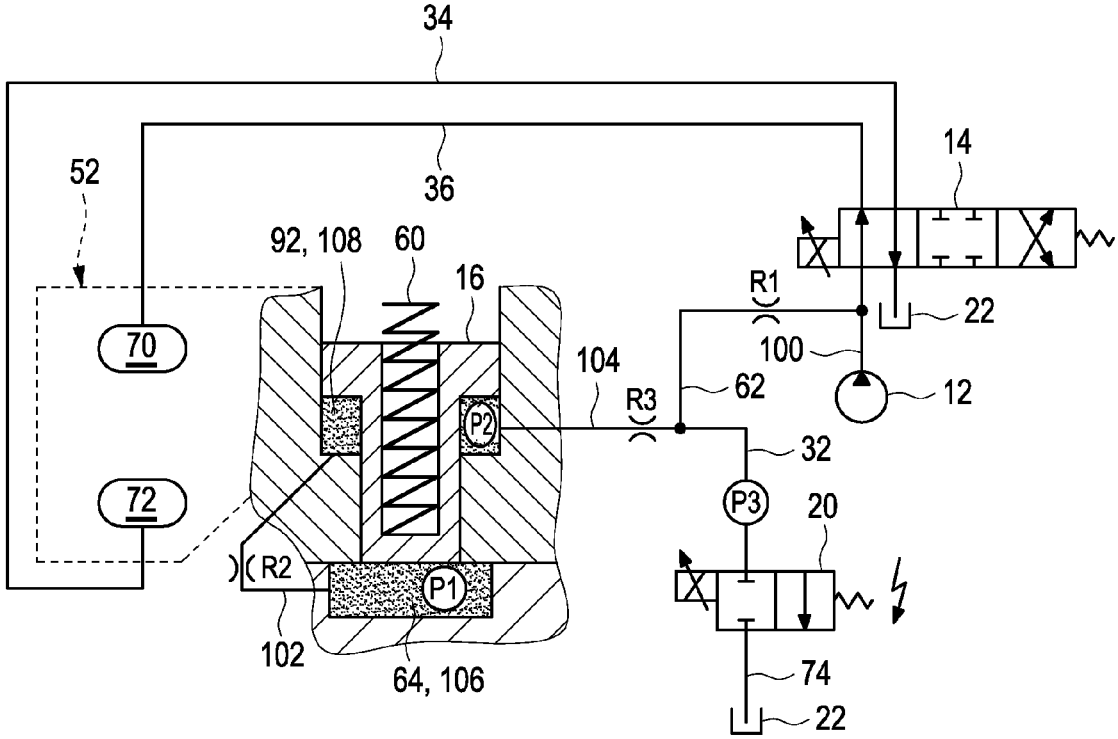
FIGS. 15*a* and 15*b* are diagrammatic illustrations of yet another embodiment of a hydraulic system for controlling the apparatus of FIGS. 12*a* and 12*b;*
Figure 15B:
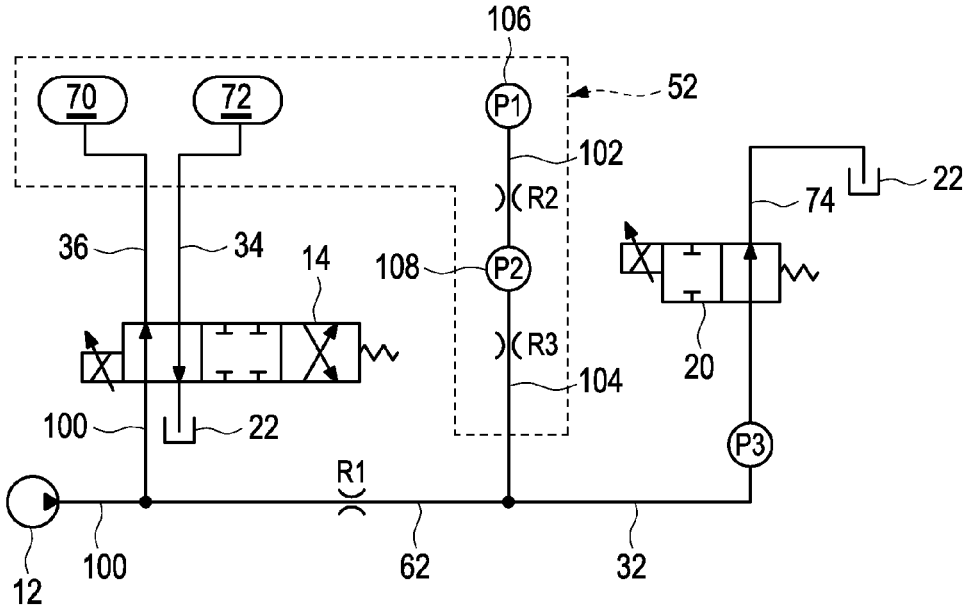

FIGS. 15*a* and 15*b* show another hydraulic system configuration of a valve timing control apparatus according to an embodiment. The overall layout is similar to the layouts depicted in FIGS. 13*a* and 13*b*, and FIGS. 14*a* and 14*b*. In contrast to the afore-mentioned hydraulic systems, the hydraulic pressure passage 100 is directly connected by an orifice R1 to the on/off check valve 20, wherein the locking pin activation passage 104 is connected to the pressure passage 100 which is located after the orifice R1 labeled as locking pin supply passage 62. The locking pin 16 is therefore directly fed by the oil supply without any valve in front thereof. The oil flow to the locking pin 16 is controlled by a fixed orifice R1 and the locking pin 16 can be vented by the on/off control valve 20. The hydraulic system for activating or deactivating the locking pin 16 is much simpler as in the hydraulic systems described beforehand because a single locking pin supply passage 62 must be provided which starts from the pressure passage 100 and leads to the on/off control valve 20 and the locking pin supply passage 104. Therefore the constructional effort is highly reduced and locking/unlocking of locking pin 16 is independent from activation of oil control valve 14.

Figure 16:
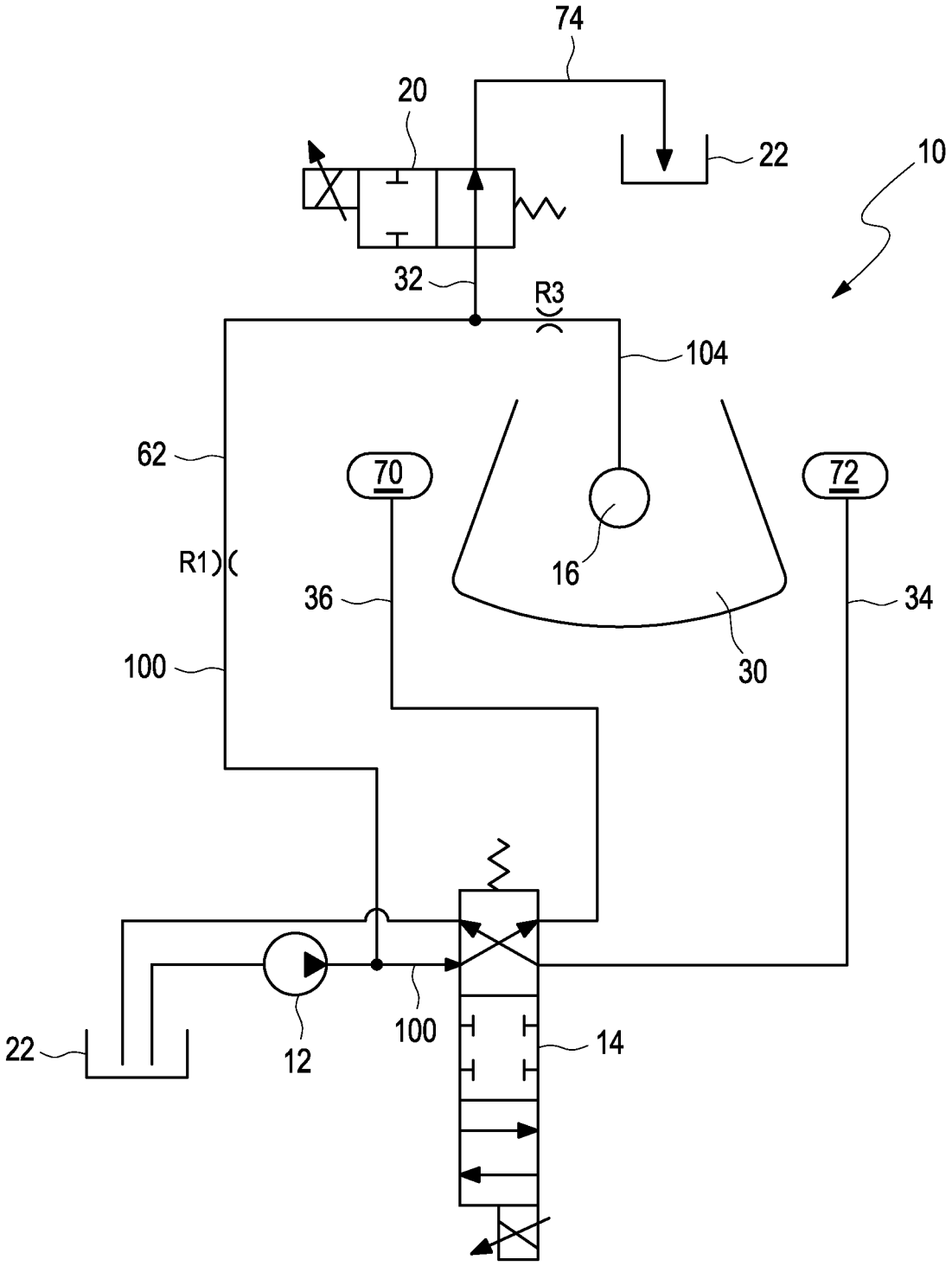
FIG. 16 is a diagrammatic illustration of another embodiment of a valve timing control apparatus.
Figure 17:
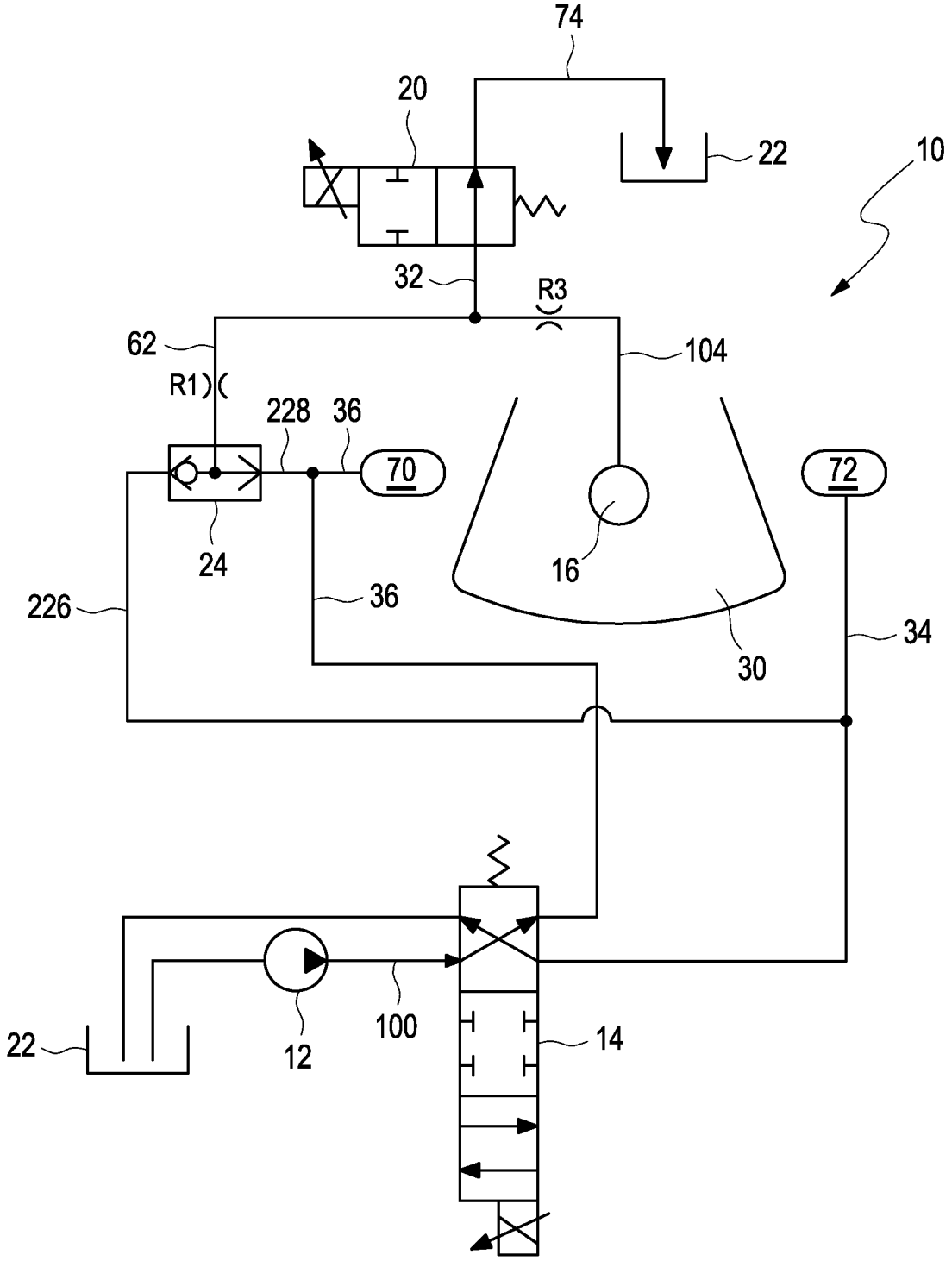
FIG. 17 is a diagrammatic illustration of another embodiment of a valve timing control apparatus.

FIG. 16 is another schematic representation of the hydraulic system of the cam phasing system of a valve timing control apparatus 10, which relies on the hydraulic system depicted in FIGS. 15*a* and 15*b*. In the same way, FIG. 17 shows the overall hydraulic system of a valve timing control apparatus 10 relying on the hydraulic configuration depicted in FIGS. 13*a* and 13*b*.

Figure 18B:
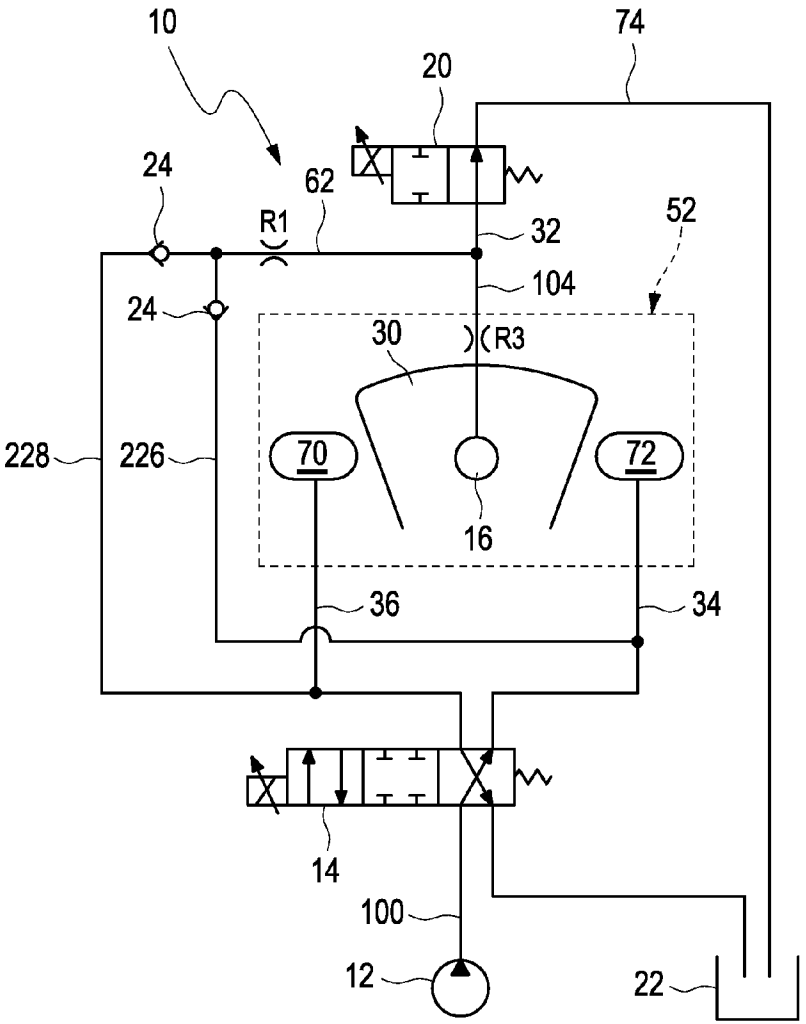
FIGS. 18*a*, 18*b*, 18*c* and 18*d* are comparative diagrammatic illustrations of different embodiments of a valve timing control apparatus.
Figure 18A:
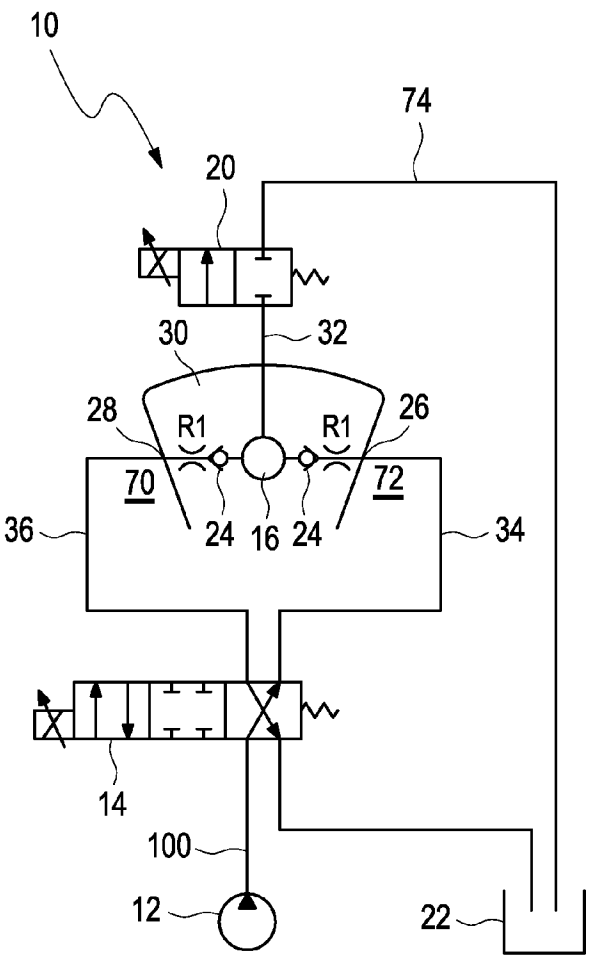
Figure 18D:
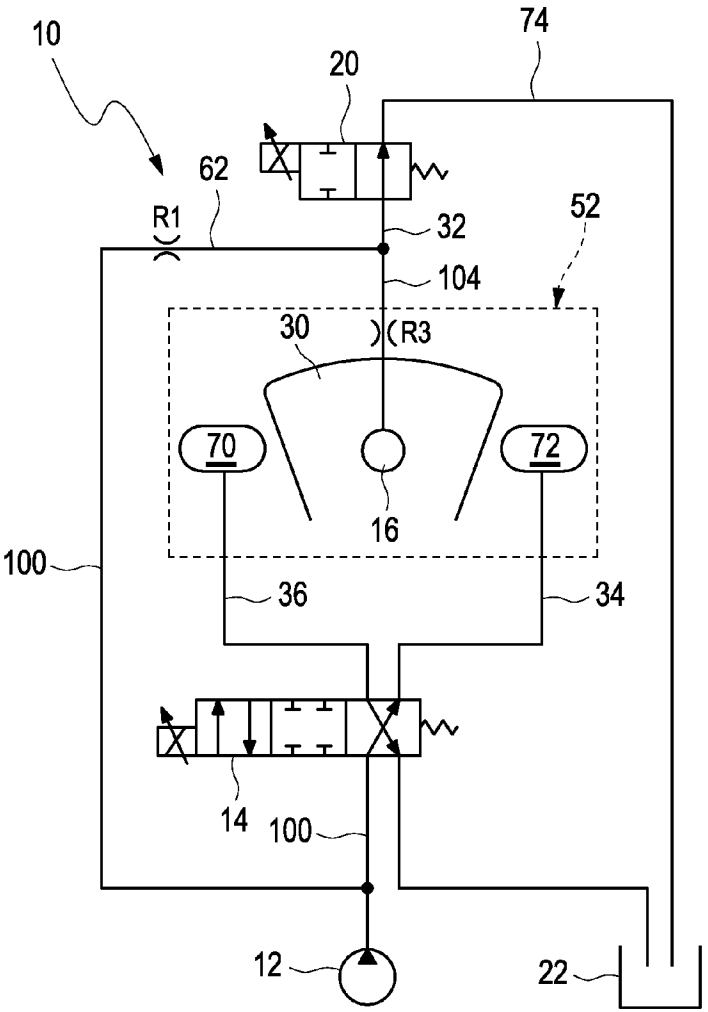
Figure 18C:
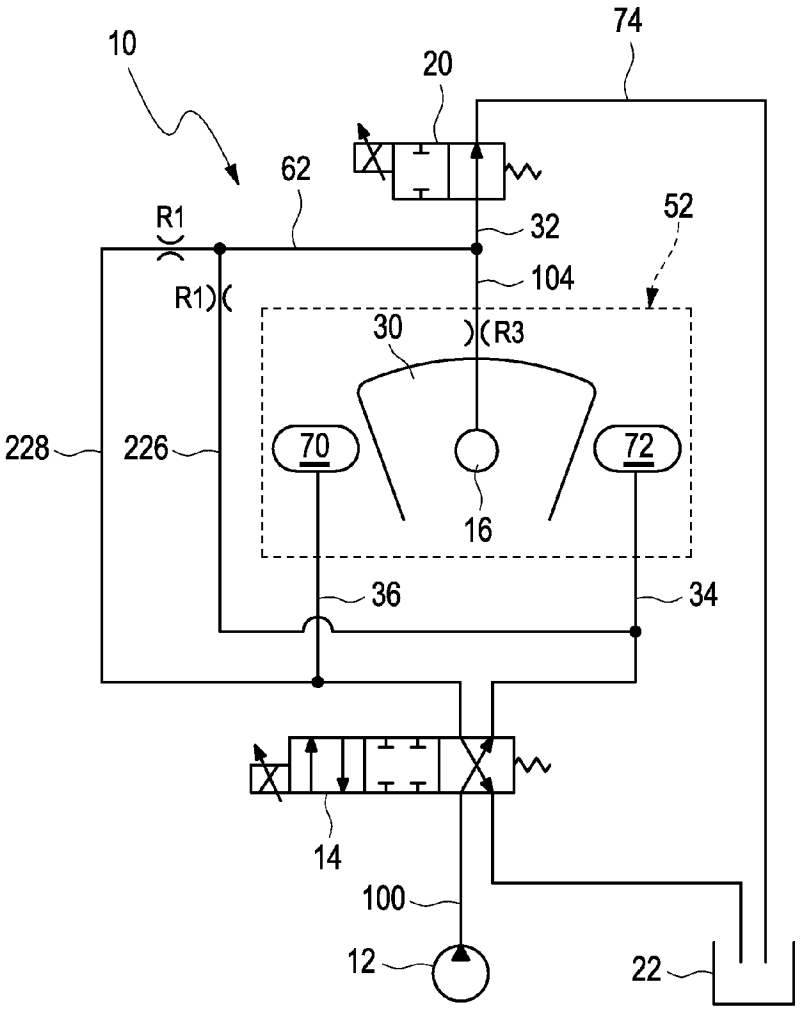

Finally, FIGS. 18*a*, 18*b*, 18*c* and 18*d* represent in comparative views the overall hydraulic systems of the embodiments shown in FIGS. 1 to 17. FIG. 18*a* depends on the hydraulic systems depicted in FIGS. 1, 10*a*, 10*b*, 11*a* and 11*b*. FIG. 18*b* depends on the hydraulic systems depicted in FIGS. 12*a*, 12*b*, 13*a*, 13*b* and 17. FIG. 18*c* depends on the hydraulic systems depicted in FIGS. 12*a*, 12*b*, 14*a* and 14*b*. FIG. 18*d* depends on the hydraulic systems depicted in FIGS. 12*a*, 12*b*, 15*a*, 15*b* and 16.

In FIG. 18*a*, the A- and B-port passages 26,28 can either include an orifice with flow resistance R1 or a check valve 24, or both in combination, such that a fluid communication between retard- and advance region 70, 72 can either be prevented by a check valve, or can be minimized to an acceptable amount by an orifice, which can be a comparatively high flow resistance R1 of A-port and B-port passage 26, 28, i.e. a narrow passage or a local reduction of a passage diameter, It is important to note that in an embodiment of the valve timing control apparatus 10 the orifice R3 of the locking pin activation passage 104 should be very low in contrast to the orifice R1 of the locking pin supply passage 62 or the A-port passage/B-port passage 26, 28, A-/B-locking pin supply passage 226, 228 respectively, such that a hydraulic flow between A-port passage and B-port passage 26, 28 or A-locking pin supply passage 226 and B-locking pin supply passage 228 can be prevented and a sufficient hydraulic pressure can be provided for unlocking locking pin 16. In an embodiment the channel of locking pin activation passage 104 should be very short and of a large diameter, thus the passage is practically not existent. Therefore it is advantageous to locate the on/off control valve 20 as a central valve within the rotor 40.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the above-described embodiments or variations may be combined in whole or in part with any one or more of the other above-described embodiments or variations.

Any spatial references such as, for example, "upper," "lower," "above," "below," "between," "bottom," "vertical," "horizontal," "angular," "upwards," "downwards," "side-toside," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

Although several exemplary embodiments have been described in detail above, the embodiments described are exemplary only and are not limiting, and those skilled in the art will readily appreciate that many other modifications, changes or substitutions are possible in the exemplary embodiments without materially departing from the novel teachings and advantages of the present disclosure. Accordingly, all such modifications, changes or substitutions are intended to be included within the scope of this disclosure as defined in the following claims. In the claims, means-plus-function clauses are intended to cover the structures described herein as performing the recited function and not only structural equivalents, but also equivalent structures.

REFERENCE NUMERALS

10 Valve timing control apparatus
12 Pump
14 Oil control valve
16 Locking pin
18 Bore
20 On/off control valve
22 Oil reservoir
24 Check valve
26 A-port passage
28 B-port passage
30 Vane
32 Release passage/locking control passage
34 Advance passage
36 Retard passage
38 Electronic control unit ECU
40 Rotor
42 Camshaft
44 Center portion of rotor
46 Axial slot
48 Division bars
50 Sprocket
52 Phaser
54 Stator housing
56 Cover
58 Check ring—acts as shuttle valve or two check valves
60 Compression spring
62 Locking pin supply passage
64 Recess in sprocket
66 Radial slot in sprocket
68 Radial passage
70 Retard region
72 Advance region
74 Oil return passage
76 Clip
78 Advance groove
80 Retard groove
82 Front vent passage
84 Radial slot in vane
86 Locking control groove
90 Notch
92 Annular channel
94 Inner surface of locking pin as spring holder
96 Axially extending opening of locking pin for receiving spring
98 Enlarged-diameter portion of locking pin
100 Pressure passage
102 Connecting passage between locking ring chamber and locking hole chamber
104 Locking pin activation passage
106 Locking hole chamber
108 Locking ring chamber
110 Electric connector
112 Valve housing
114 Armature
116 Valve coil
118 Fork
120 Center pole
122 Bushing
124 Control filter
126 Valve ball
128 Supply filter
130 Pintle
132 Snout/bobbin
226 A-Locking pin supply passage
228 B-Locking pin supply passage

What is claimed is:

1. A valve timing control apparatus for a combustion engine, the apparatus comprising: a rotational member adapted to be driven by said combustion engine; a rotor adapted to be mechanically coupled with a camshaft for controlling opening and closing of cylinder valves of said combustion engine; a first valve for controlling an adjustable position between said rotational member and said rotor; and a second valve for switching between; a first configuration in which the second valve is in a first position and the rotor is locked to the rotational member; and a second configuration in which the second valve is in a second position and the rotor is unlocked from the rotational member, such that the opening and closing of the cylinder valves in relation to said engine's rotational state can be controlled by the adjustable position between said rotational member and said rotor and thus by the first valve, further comprising a locking pin being axially aligned with said rotational member and said rotor, wherein said locking pin is hydraulically operated for locking said rotational member with said rotor in an intermediate-position, further comprising a stator housing in which the rotor is rotatably embedded, wherein said rotor comprises a plurality of vanes and said stator housing comprises a plurality of division bars, such that a retard region and an advance region of equal or different volumes are provided between a first lateral wall of one vane and a first division bar, and between a second lateral wall of the one vane and a second division bar, respectively, wherein said first valve is adapted to be in fluid communication with a pump via a pressure passage; wherein said retard region and said advance region are in fluid communication with said first valve via first and second fluid passages, respectively; wherein said locking pin is in fluid communication with at least one of the following: said pump, said first valve, said retard region, and said advance region; wherein said second valve is in fluid communication with said locking pin via at least one release passage; and wherein said second valve is adapted to be in fluid communication with an oil reservoir via an oil return passage, further comprising: first and second port passages formed in first and second lateral walls, respectively, and between said retard and advance regions; wherein said first port passage is formed between said locking pin and one of said retard and advance regions and said second port passage is formed between said locking pin and the other of said retard and advance regions; wherein flow of hydraulic fluid from said retard region to said locking pin is permitted via one of said first and second port passages; wherein backflow of hydraulic fluid from the locking pin to said retard region via the one of said first and second port passages is prevented or at least resisted; wherein flow of hydraulic fluid from said advance region to said locking pin is permitted via the other of said first and second port passages; and wherein backflow of hydraulic fluid from the locking pin to said advance region via the other of said first and second port passages is prevented or at least resisted.

2. The apparatus according to claim 1, wherein said locking pin supply passage comprises a first orifice having a first flow resistance; wherein the apparatus further comprises at least one other orifice through which hydraulic fluid flows before flowing to the locking pin supply passage, the at least one other orifice having a second flow resistance that is much larger than the first flow resistance.

3. The apparatus according to claim 2, wherein said second valve is arranged centrally in a hub of said rotor, such that said first flow resistance is practically zero.

4. The apparatus according to claim 1, further comprising at least one check valve preventing an exchange of hydraulic fluid between said retard and advance regions.

5. The apparatus according to claim 4, wherein said at least one check valve is a shuttle valve.

6. A valve timing control apparatus for a combustion engine, the apparatus comprising: a rotational member adapted to be driven by said combustion engine; a rotor adapted to be mechanically coupled with a camshaft for controlling opening and closing of cylinder valves of said combustion engine; a first valve for controlling an adjustable position between said rotational member and said rotor; and a second valve for switching between; a first configuration in which the second valve is in a first position and the rotor is locked to the rotational member; and a second configuration in which the second vale is in a second position and the rotor is unlocked from the rotational member, such that the opening and closing of the cylinder valves in relation to said engine's rotational state can be controlled by the adjustable position between said rotational member and said rotor and thus by the first valve, further comprising a locking pin being axially aligned with said rotational member and said rotor, wherein said locking pin is hydraulically operated for locking said rotational member with said rotor in an intermediate-position, further comprising a stator housing in which the rotor is rotatably embedded, wherein said rotor comprises a plurality of vanes and said stator housing comprises a plurality of division bars, such that a retard region and an advance region of equal or different volumes are provided between a first lateral wall of one vane and a first division bar, and between a second lateral wall of the one vane and a second division bar, respectively, wherein said first valve is adapted to be in fluid communication with a pump via a pressure passage; wherein said retard region and said advance region are in fluid communication with said first valve via first and second fluid passages, respectively; wherein said locking pin is in fluid communication with at least one of the following: said pump, said first valve, said retard region, and said advance region; wherein said second valve is in fluid communication with said locking pin via at least one release passage; and wherein said second valve is adapted to be in fluid communication with an oil reservoir via an oil return passage, wherein said locking pin is in fluid communication with said second valve via two release passages; and wherein the first and second port passages are hydraulically decoupled from each other and are coupled to respective ones of the two release passages via said locking pin such that hydraulic fluid is separately flowable between said retard and advance regions through said locking pin towards said second valve via respective ones of said two release passages.

7. A valve timing control apparatus for a combustion engine, the apparatus comprising: a rotational member adapted to be driven by said combustion engine; a rotor adapted to be mechanically coupled with a camshaft for controlling opening and closing of cylinder valves of said combustion engine; a first valve for controlling an adjustable position between said rotational member and aid rotor; and a second valve for switching between; a first configuration in which the second valve is in a first position and the rotor is locked to the rotational member; and a second configuration in which the second valve is in a second position and the rotor is unlocked from the rotational member, such that the opening and closing of the cylinder valves in relation to said engine's rotational state can be controlled by the adjustable position between said rotational member and said rotor and thus by the first valve, further comprising a locking pin being axially aligned with said rotational member and said rotor, wherein said locking pin is hydraulically operated for locking said rotational member with said rotor in an intermediate-position, further comprising a stator housing in which the rotor is rotatably embedded, wherein said rotor comprises a plurality of vanes and said stator housing comprises a plurality of division bars, such that a retard region and an advance region of equal or different volumes are provided between a first lateral wall of one vane and a first division bar, and between a second lateral wall of the one vane and a second division bar, respectively, wherein said first valve is adapted to be in fluid communication with a pump via a pressure passage; wherein said retard region and said advance region are in fluid communication with said first valve via first and second fluid passages, respectively; wherein said locking pin is in fluid communication with at least one of the following: said pump, said first valve, said retard region, and said advance region; wherein said second valve is in fluid communication with said locking pin via at least one release passage; and wherein said second valve is adapted to be in fluid communication with an oil reservoir via an oil return passage, wherein said locking pin is in fluid communication with said second valve via a locking pin activation passage and said release passage, said locking pin activation passage and said release passage being in fluid communication with a locking pin supply passage.

8. The apparatus according to claim 7, wherein said locking pin supply passage comprises a first orifice having a first flow resistance; wherein the apparatus further comprises at least one other orifice through which hydraulic fluid flows before flowing to the locking pin supply passage, the at least one other orifice having a second flow resistance that is much larger than the first flow resistance.

9. The apparatus according to claim 8, wherein said second valve is arranged centrally in a hub of said rotor, such that said first flow resistance is practically zero.

10. The apparatus according to claim 7, further comprising at least one check valve preventing an exchange of hydraulic fluid between said retard and advance regions.

11. The apparatus according to claim 10, wherein said at least one check valve is a shuttle valve.

12. The apparatus according to claim 7, said locking pin supply passage being in fluid communication with said pressure passage, such that each of said retard and advance regions is hydraulically decoupled from said locking pin.

13. The apparatus according to claim 12, wherein said locking pin supply passage comprises a first orifice having a first flow resistance; wherein the apparatus further comprises at least one other orifice via which hydraulic fluid flows before flowing to the locking pin supply passage, the at least one other orifice having a second flow resistance that is much larger than the first flow resistance.

14. The apparatus according to claim 13, wherein said second valve is arranged centrally in a hub of said rotor, such that said first flow resistance is practically zero.

15. The apparatus according to claim 12, further comprising at least one check valve preventing an exchange of hydraulic fluid between said retard and advance regions.

16. The apparatus according to claim 15, wherein said at least one check valve is a shuttle valve.

17. The apparatus according to claim 7, wherein said locking pin supply passage is in fluid communication with said first and second fluid passages.

18. The apparatus according to claim 17, wherein said locking pin supply passage comprises a first orifice having a first flow resistance; wherein the apparatus further comprises at least one other orifice through which hydraulic fluid flows before flowing to the locking pin supply passage, the at least one other orifice having a second flow resistance that is much larger than the first flow resistance.

19. The apparatus according to claim 18, wherein said second valve is arranged centrally in a hub of said rotor, such that said first flow resistance is practically zero.

20. The apparatus according to claim 17, further comprising at least one check valve preventing an exchange of hydraulic fluid between said retard and advance regions.

21. The apparatus according to claim 20, wherein said at least one check valve is a shuttle valve.

* * * * *